US012722754B2

(12) United States Patent
Allen et al.

(10) Patent No.: US 12,722,754 B2
(45) Date of Patent: Sep. 1, 2026

(54) HEEL TANK DAMPER FOR FLOATING STRUCTURES

(71) Applicant: University of Maine System Board of Trustees, Orono, ME (US)

(72) Inventors: Christopher K. Allen, Bangor, ME (US); Andrew J. Goupee, Ellsworth, ME (US); Richard Kimball, Sedgwick, ME (US); Anthony M. Viselli, Bangor, ME (US); Habib J. Dagher, Veazie, ME (US)

(73) Assignee: University of Maine System Board of Trustees, Orono, ME (US)

( * ) Notice: Subject to any disclaimer, the term of this patent is extended or adjusted under 35 U.S.C. 154(b) by 392 days.

(21) Appl. No.: 18/372,832

(22) Filed: Sep. 26, 2023

(65) Prior Publication Data

US 2024/0101232 A1 Mar. 28, 2024

Related U.S. Application Data

(60) Provisional application No. 63/409,885, filed on Sep. 26, 2022.

(51) Int. Cl.
*B63B 39/03* (2006.01)
*B63B 35/44* (2006.01)

(52) U.S. Cl.
CPC ..... *B63B 39/03* (2013.01); *B63B 2035/446* (2013.01)

(58) Field of Classification Search
CPC ..... B63B 39/00; B63B 39/005; B63B 39/02; B63B 39/03; B63B 2039/067; B63B 35/00; B63B 35/44; B63B 35/4433; B63B 35/446; Y02E 10/72; Y02E 10/727; F05B 2240/932; F05B 2240/95; F03D 13/256
USPC ..... 114/121, 122, 123, 124, 125
See application file for complete search history.

(56) References Cited

U.S. PATENT DOCUMENTS

2011/0135398 A1* 6/2011 Lopez ..... F03D 13/22 290/55
2015/0136006 A1* 5/2015 Rodriguez ..... B63B 39/06 114/121
2021/0387702 A1* 12/2021 Allen ..... B63B 39/02

FOREIGN PATENT DOCUMENTS

WO WO-2012169914 A1 * 12/2012 ..... F03D 13/25

* cited by examiner

*Primary Examiner* — Daniel V Venne
(74) *Attorney, Agent, or Firm* — MacMillan, Sobanski & Todd, LLC

(57) ABSTRACT

A barge-type wind turbine platform in combination with a heel tank damper includes a barge-type wind turbine platform having a keystone, two pairs of bottom beams, each including two bottom beams connected to opposite sides of the keystone, wherein the combined pairs of bottom beams define a foundation. A U-shaped ballast conduit is mounted or formed within each of the pairs of bottom beams. Each ballast conduit has ballast water therein, the ballast water extending from an outwardly extending portion of each bottom beam of each pair of bottom beams, such that a volume of air is defined between a surface of the ballast water in each outwardly extending portion and an outwardly facing wall of each outwardly extending portion, and an internal damping element is provided within each ballast conduit. A heel tank damper is defined by the ballast conduits and their respective internal damping elements.

30 Claims, 12 Drawing Sheets

HEEL TANK DAMPER FOR FLOATING STRUCTURES

BACKGROUND

This invention relates in general to floating platforms. In particular, this invention relates to an improved floating offshore wind turbine (FOWT) platform having an improved mass damper system configured to mitigate unwanted dynamic responses from heel motion during operation.

Wind turbines for converting wind energy to electrical power are known and provide an alternative energy source for power companies. On land, large groups of wind turbines, often numbering in the hundreds of wind turbines, may be placed together in one geographic area. These large groups of wind turbines can generate undesirably high levels of noise and may be viewed as aesthetically unpleasing. An optimum flow of air may not be available to these land-based wind turbines due to obstacles such as hills, woods, and buildings.

Groups of wind turbines may also be located offshore, but near the coast at locations where water depths allow the wind turbines to be fixedly attached to a foundation on the seabed. Over the ocean, the flow of air to the wind turbines is not likely to be disturbed by the presence of various obstacles (i.e., as hills, woods, and buildings) resulting in higher mean wind speeds and more power. The foundations required to attach wind turbines to the seabed at these near-coast locations are relatively expensive, and can only be accomplished at relatively shallow depths, such as a depth of up to about 45 meters.

The U.S. National Renewable Energy Laboratory has determined that winds off the U.S. Coastline over water having depths of 30 meters or greater have an energy capacity of about 3,200 TWh/yr. This is equivalent to about 90 percent of the total U.S. energy use of about 3,500 TWh/yr. The majority of the offshore wind resource resides between 37 and 93 kilometers offshore where the water is over 60 meters deep. Fixed foundations for wind turbines in such deep water are likely not economically feasible. This limitation has led to the development of floating platforms for wind turbines. Known floating wind turbine platforms may be anchored to the seabed with mooring lines and provide some stability to the tower and turbine against external loading from wind, waves, and current, as well as loading associated with the dynamics of the wind turbine mounted thereon. Floating wind turbine platforms and the tower and turbine mounted thereon however, may still experience undesirable instability due to external loading from the wind, waves, and current.

It would be desirable therefore to provide a floating wind turbine platform with an improved mass damper system configured to mitigate unwanted dynamic responses from heel motion during operation.

SUMMARY OF THE INVENTION

This application describes various embodiments of a FOWT platform having an improved mass damper system configured to mitigate unwanted dynamic responses from heel motion during operation. In one embodiment, a barge-type wind turbine platform is capable of floating on a body of water and supporting a wind turbine thereon in combination with a heel tank damper includes a barge-type wind turbine platform having a keystone, a first pair bottom beams including two bottom beams connected to opposite sides of the keystone, a second pair of bottom beams including two bottom beams connected to opposite sides of the keystone, wherein the second pair of bottom beams has a longitudinal axis perpendicular to a longitudinal axis of the first pair of the bottom beams, and the combined first and second pairs of bottom beams define a foundation. Each bottom beam in the first and second pairs of bottom beams includes an outwardly extending portion at a distal end thereof a U-shaped ballast conduit is mounted or formed within each of the pairs of bottom beams and extends between the outwardly extending portions of each bottom beam of each pair of bottom beams. Each ballast conduit has ballast water therein, the ballast water extending from the outwardly extending portions of each bottom beam of each pair of bottom beams, such that a volume of air is defined between a surface of the ballast water in each outwardly extending portion and an outwardly facing wall of each outwardly extending portion, and an internal damping element is provided within each ballast conduit. A heel tank damper is defined by the ballast conduits and their respective internal damping elements.

In a second embodiment, a method of mitigating dynamic responses from heel motion in a barge-type wind turbine platform capable of floating on a body of water and supporting a wind turbine thereon includes a barge-type wind turbine platform having a keystone, a first pair bottom beams including two bottom beams connected to opposite sides of the keystone, a second pair of bottom beams including two bottom beams connected to opposite sides of the keystone, wherein the second pair of bottom beams has a longitudinal axis perpendicular to a longitudinal axis of the first pair of the bottom beams, the combined first and second pairs of bottom beams defining a foundation, wherein each bottom beam in the first and second pairs of bottom beams includes an outwardly extending portion at a distal end thereof, wherein the first and second pairs bottom beams define a foundation having a cruciform shape, wherein a U-shaped ballast conduit is one of mounted and formed within each of the pairs of bottom beams and extends between the outwardly extending portions of each bottom beam of each pair of bottom beams, and wherein each ballast conduit has ballast water therein, the ballast water extending from the outwardly extending portions of each bottom beam of each pair of bottom beams, such that a volume of air is defined between a surface of the ballast water in each outwardly extending portion and an outwardly facing wall of each outwardly extending portion, and an internal damping element within each ballast conduit. A heel tank damper is defined by the ballast conduits and their respective internal damping element. The method includes mitigating dynamic responses from heel motion by using the ballast water within the ballast conduits as a mass element that is allowed to oscillate in a predetermined direction.

In another embodiment, a barge-type wind turbine platform capable of floating on a body of water and supporting a wind turbine thereon in combination with a heel tank damper includes a barge-type wind turbine platform having four connected bottom beams that extend radially outwardly from central point and define a foundation having a cruciform shape, wherein each bottom beam includes an outwardly extending portion at a distal end thereof, wherein an outwardly facing wall of each outwardly extending portion includes an opening that extends between an interior of the outwardly extending portion and the atmosphere outside of the outwardly extending portion, and a cross shaped wall having four legs that extend vertically between a lower wall of each beam and an upper wall of each beam, the distal ends of each of the four legs are spaced apart from distal end walls of each beam. An integrated heel tank damper has multiple ballast conduits formed between the cross shaped wall and the walls of each beam, the ballast conduits defining multiple fluid flow paths within the foundation.

In an additional embodiment, a barge-type wind turbine platform capable of floating on a body of water and supporting a wind turbine thereon in combination with a heel tank damper includes a barge-type wind turbine platform having a keystone, a first pair bottom beams including two bottom beams connected to opposite sides of the keystone, a second pair of bottom beams including two bottom beams connected to opposite sides of the keystone, wherein the second pair of bottom beams has a longitudinal axis perpendicular to a longitudinal axis of the first pair of the bottom beams, the combined first and second pairs of bottom beams defining a foundation having a cruciform shape, wherein each bottom beam in the first and second pairs of bottom beams includes an outwardly extending portion at a distal end thereof, wherein a U-shaped ballast conduit is mounted or formed within each of the pairs of bottom beams and extends between the outwardly extending portions of each bottom beam of each pair of bottom beams, and wherein each ballast conduit has ballast water therein, the ballast water extending from the outwardly extending portions of each bottom beam of each pair of bottom beams, such that a volume of air is defined between a surface of the ballast water in each outwardly extending portion and an outwardly facing wall of each outwardly extending portion, an interior wall within each bottom beam that extends vertically between a lower wall and an upper wall of each bottom beam, and further extends longitudinally from distal end walls of each bottom beam to a vertically extending exterior wall of the keystone, and a cross-shaped wall within the keystone extends vertically between a lower wall and an upper wall of the keystone, wherein each leg of the cross-shaped wall is longitudinally aligned with one of the interior walls of the bottom beams, and wherein the exterior walls and each of the legs of the cross-shaped wall of the keystone have vertically extending fluid flow openings formed therein, and define an internal damping element. A heel tank damper system is defined by the combination of the ballast conduits and a plurality of fluid flow paths defined by the fluid flow openings in the walls of the keystone.

In a further embodiment, a semi-submersible wind turbine platform capable of floating on a body of water and supporting a wind turbine thereon in combination with a heel tank damper includes a semi-submersible wind turbine foundation having a keystone, three bottom beams that extend radially outwardly from the keystone, a center column mounted to the keystone, three outer columns mounted at distal ends of the bottom beams, wherein a space within the center column, each outer column, the keystone and the bottom beam therebetween define three generally U-shaped ballast conduits, and wherein each ballast conduit has ballast water therein, the ballast water extending from an upper portion of the center column to an upper portion of the outer columns, such that a volume of air is defined between a surface of the ballast water in each column and an outwardly facing wall of each column, and an internal damping element within each ballast conduit. A heel tank damper is defined by the combination of the three ballast conduits.

Various advantages of the invention will become apparent to those skilled in the art from the following detailed description, when read in view of the accompanying drawings.

DETAILED DESCRIPTION OF THE PREFERRED EMBODIMENT

The present invention will now be described with occasional reference to the illustrated embodiments of the invention. This invention may, however, be embodied in different forms and should not be construed as limited to the embodiments set forth herein, nor in any order of preference.

Rather, these embodiments are provided so that this disclosure will be more thorough, and will convey the scope of the invention to those skilled in the art.

The embodiments of the invention disclosed below generally provide improvements to floating offshore wind turbine (FOWT) platforms that include, but are not limited to, providing an improved mass damper system configured to mitigate unwanted dynamic responses from heel motion during operation.

As used herein, the term parallel is defined as in a plane substantially parallel to the horizon. The term vertical is defined as substantially perpendicular to the plane of the horizon.

As used herein, the term heel or heeling refers to a rotation resulting from the combined effects about the roll and pitch axes as may be caused by wind pressure, waves, and/or current.

The embodiments of the improved FOWT platforms described and illustrated herein are suitable for commercial scale floating turbines with a power capacity within the range of about 15 MW to about 30 MW. The improved FOWT platforms described and illustrated herein may also be suitable for commercial scale floating turbines with a power capacity greater than about 30 MW and less than about 15 MW. Advantageously, the improved FOWT platforms described and illustrated herein have an improved mass damper system configured to mitigate undesirable dynamic responses of the FOWT platforms, such as from heel motion during operation.

Figure 1:
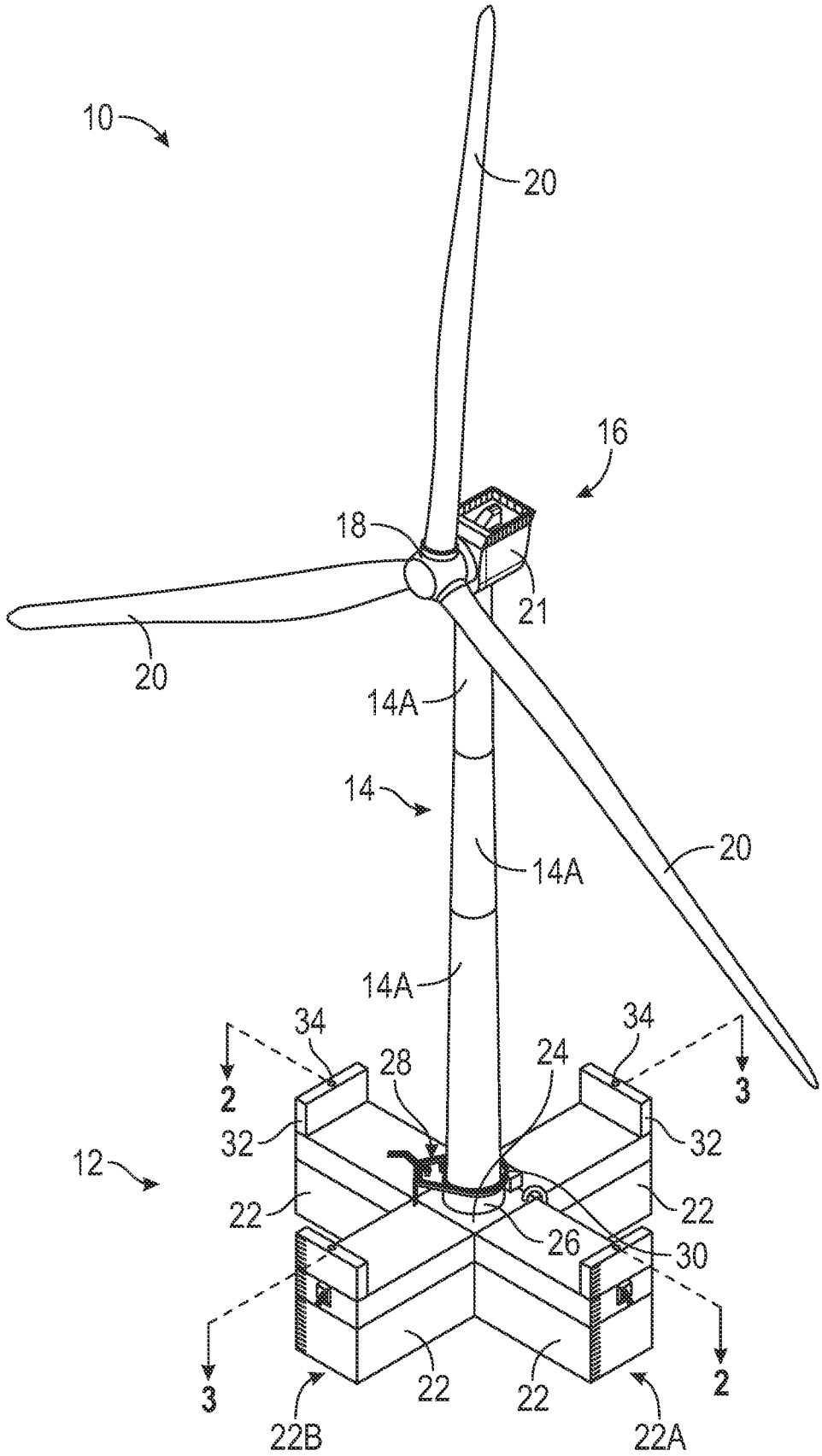
FIG. 1 is a perspective view of a first embodiment of an improved barge-type Floating Offshore Wind Turbine (FOWT) platform in accordance with this invention and shown with a wind turbine and wind turbine tower mounted thereon.
Figure 2:
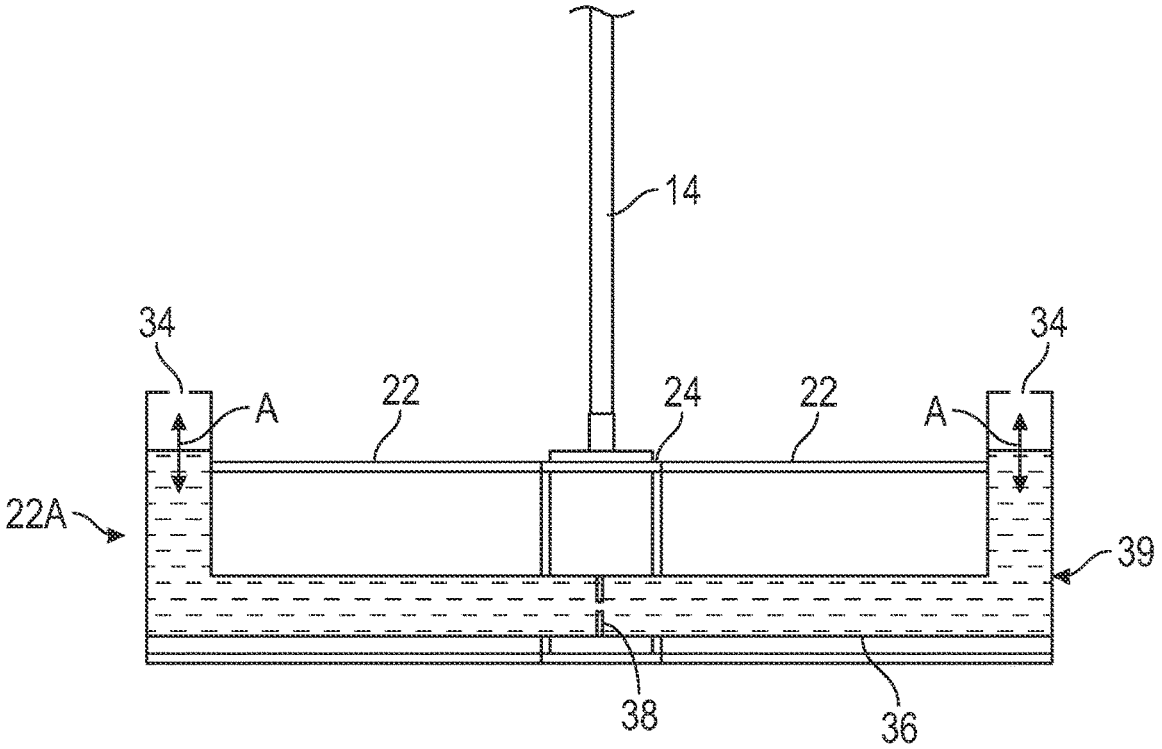
FIG. 2 is a cross-sectional view taken along the line 2-2 in FIG. 1.
Figure 3:
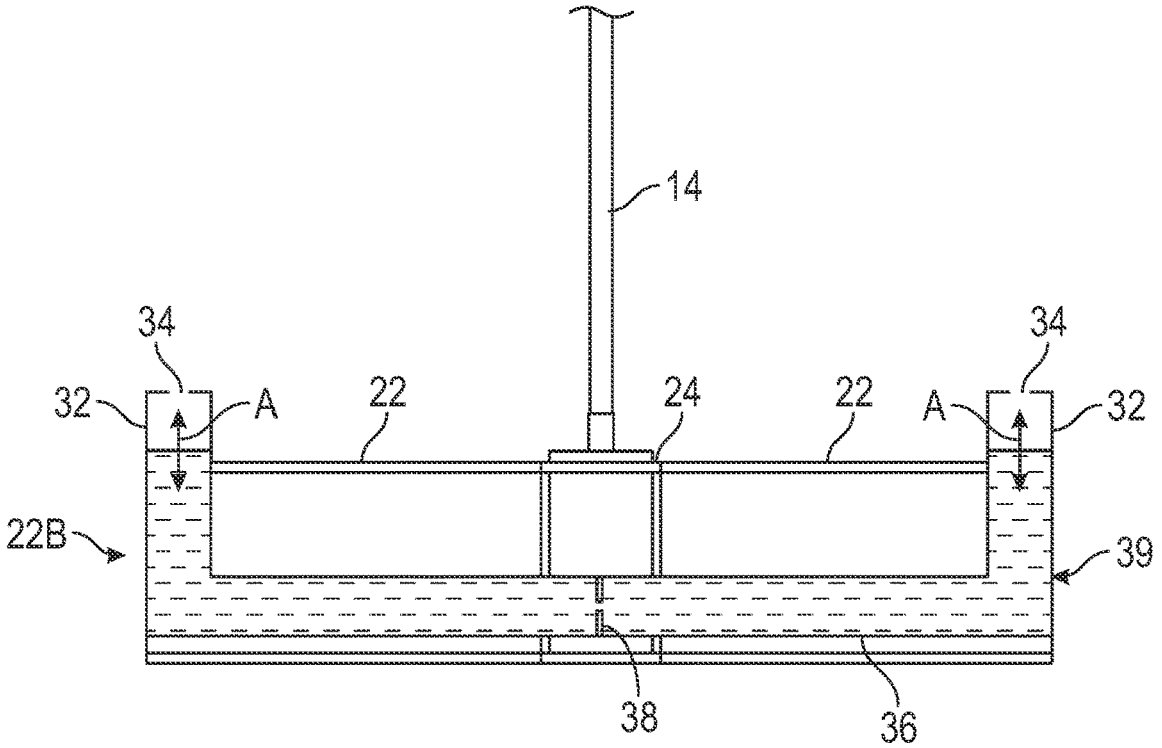
FIG. 3 is a cross-sectional view taken along the line 3-3 in FIG. 1.

Referring to the drawings, particularly to FIGS. 1 through 3, a first embodiment of an improved FOWT platform according to this invention is shown generally at 10.

The illustrated FOWT platform 10 includes a hull or foundation 12 that supports a wind turbine tower 14. The wind turbine tower 14 supports a wind turbine 16. The foundation 12 is a barge-type foundation, and is structured and configured to float in a body of water. Accordingly, a portion of the foundation 12 will be above water when the foundation 12 is floating in the water. Mooring lines (not shown) may be attached to the FOWT platform 10 and further attached to anchors (not shown) in the seabed to limit to movement of the FOWT platform 10 on the body of water.

In the illustrated embodiment, the wind turbine tower 14 is tubular and may have any suitable outside diameter and height. In the illustrated embodiment, the outside diameter of the wind turbine tower 14 tapers from a first diameter at its base to a second, smaller diameter at its upper end. Alternatively, the outside diameter of the wind turbine tower 14 may have a uniform diameter. The wind turbine tower 14 may be formed from any desired material, including but not limited to steel, concrete, fiber reinforced polymer (FRP) composite material, and a composite laminate material. If desired, the wind turbine tower 14 may be formed in any number of sections 14A.

The wind turbine 16 may be conventional and may include a rotatable hub 18. At least one rotor blade 20 is coupled to, and extends outward from, the hub 18. The hub 18 is rotatably coupled to an electric generator (not shown). The electric generator may be coupled via a transformer (not shown) and an underwater power cable (not shown) to a power grid (not shown). In the illustrated embodiment, the hub 18 has three rotor blades 20. In other embodiments, the hub 18 may have more or less than three rotor blades 20. A nacelle 21 is attached to the wind turbine 16 opposite the hub 18.

Typically, a lower portion of the foundation 12 may be submerged at a depth within the range of about 30 ft to about 100 ft (about 9.1 m to about 30.5 m). Accordingly, a portion of the foundation 12 will be above water when the foundation 12 is floating, semi-submerged, in the water, and a portion of the foundation 12 is also below the waterline. As used herein, the waterline is defined as the approximate line where the surface of the water meets the FOWT platform 10.

The illustrated foundation 12 may be formed from four bottom beams 22 that extend radially outwardly from a keystone 24 and provide buoyancy. When assembled together, the bottom beams 22 and the keystone 24 define the foundation 12 having a cruciform shape, i.e., having the shape of a cross. Additionally, the keystone 24 supports the tower 14. The tower 14 may be mounted to the keystone 24 via a transition member 26, configured for example, as a steel tube.

If desired, a work platform 28 may be mounted at a base of the tower 14, and may include access-ways or catwalks 30 mounted around all or a portion of the base of the tower 14 and/or the work platform 28.

In the embodiments illustrated herein, the wind turbine 16 is a horizontal-axis wind turbine. Alternatively, the wind turbine may be a vertical-axis wind turbine (not shown). The size of the wind turbine 16 will vary based on the wind conditions at the location where the FOWT platform 10 is anchored and the desired power output. For example, the wind turbine 16 may have an output of about 15 MW. Alternatively, the wind turbine 16 may have an output within the range of from about 15 MW to about 30 MW. Additionally, the wind turbine 16 may have an output of less than about 15 MW or more than about 30 MW.

The illustrated keystone 24 is formed from pre-stressed reinforced concrete, and may include one or more internal cavities, described below. Any desired process may be used to manufacture the keystone 24, such as a spun concrete process or with conventional concrete forms. Alternatively, other processes such as those used in the precast concrete industry may also be used. The concrete of the keystone 24 may be reinforced with any conventional reinforcement material, such as high tensile steel cable and high tensile steel reinforcement bars or REBAR. Alternatively, the keystone 24 may be formed from high performance concrete, FRP, steel, or combinations of pre-stressed reinforced concrete, high performance concrete, FRP, and steel.

The illustrated bottom beams 22 are formed from pre-stressed reinforced concrete as described above. Alternatively, the bottom beams 22 may be formed from high performance concrete, FRP, steel, or combinations of pre-stressed reinforced concrete, high performance concrete, FRP, and steel. The bottom beams 22 may be formed having any desired length.

The keystone 24 and the bottom beams 22 may then be assembled and post-tensioned longitudinally to define pairs of bottom beams 22A and 22B, and thus the foundation 12. The keystone 24 and the bottom beams 22 may be post-tensioned by any desired post-tensioning method, thus applying a compressive force between the keystone 24 and the bottom beams 22.

As shown in FIGS. 1 through 3, each bottom beam 22 includes an outwardly extending portion 32 at a distal end thereof (upwardly extending when viewing FIGS. 1 through 3). An upwardly facing wall of each outwardly extending portion 32 includes an opening 34 that extends between an interior of the outwardly extending portion 32 and the atmosphere outside of the outwardly extending portion 32.

A first pair of the bottom beams 22A is shown in cross-section in FIG. 2 and includes two bottom beams 22 connected to opposite sides of the keystone 24, and a second pair 22B of the bottom beams 22 is shown in cross-section in FIG. 3 and includes two bottom beams 22 connected to opposite sides of the keystone 24 and having a longitudinal axis perpendicular to a longitudinal axis of the first pair of the bottom beams 22A. A generally U-shaped ballast conduit 36 is mounted or formed within each of the pairs of bottom beams 22A, 22B and extends between the outwardly extending portions 32 of each bottom beam 22 of each pair of bottom beams 22A, 22B. Each ballast conduit 36 also includes an internal damping element 38 within the ballast conduit 36. The internal damping element 38 may be any desired damping element, including but not limited to a wall or partition having a fixed opening or orifice therethrough, a wall or partition having a movable or otherwise adjustable orifice therethrough, a gate valve, and or any other valve or structure that reduces or controls the flow of ballast water between the bottom beams 22 of the pairs of bottom beams 22A, 22B. The ballast conduits 36 and their respective internal damping elements 38 define a heel tank damper 39.

As shown in FIGS. 2 and 3, each ballast conduit 36 is filled with fluid or ballast water, such as sea water. It will be understood that each ballast conduit 36 will include a valve and/or a pump (not shown) to selectively add and remove ballast water from each ballast conduit 36. Because each of the outwardly extending portion 32 includes the opening 34 that is open to the atmosphere outside of the foundation 12, ballast water with the pairs of bottom beams 22A, 22B may move up or down within the outwardly extending portions 32, as shown by the arrows A, when the FOWT platform 10 is caused to move such as due to heel motion, turbine harmonic loading, or wave environment loading. It will be understood that the ballast conduit 36 within the pair of bottom beams 22A is fluidly connected to the ballast conduit 36 within the pair of bottom beams 22B. It will be further understood that that the ballast conduit 36 within the pair of bottom beams 22A may, if desired, cross over, under, or through (via one or more pipes or tubes) the ballast conduit 36 within the pair of bottom beams 22B, as described herein below.

Advantageously, the FOWT platform 10 having the heel tank damper 39 is configured to mitigate undesirable dynamic responses of the FOWT platform 10, such as from heel motion during operation.

The mitigation of undesirable dynamic responses, as described above, may be accomplished at least in part, by:

(1) Using internal fluid ballast, i.e., the ballast water, within the ballast conduit 36 of the foundation 12 as the mass element of a damper system which is allowed to oscillate in a prescribed or predetermined direction, as shown by the arrows A in FIGS. 2 and 3.

(2) Using the ballast water within the ballast conduit 36 of the foundation 12, wherein the frequency response of the internal fluid ballast is dictated by the total mass of the fluid within the ballast conduit 36, a total submerged length of the ballast conduit 36, and the free surface area at each vertical end of the ballast conduit 36, i.e., within the outwardly extending portions 32.

(3) Using the internal damping element 38, such as an orifice, within the ballast conduit 36 containing the ballast water as a means to control the fluid mass response phase.

Figure 4:
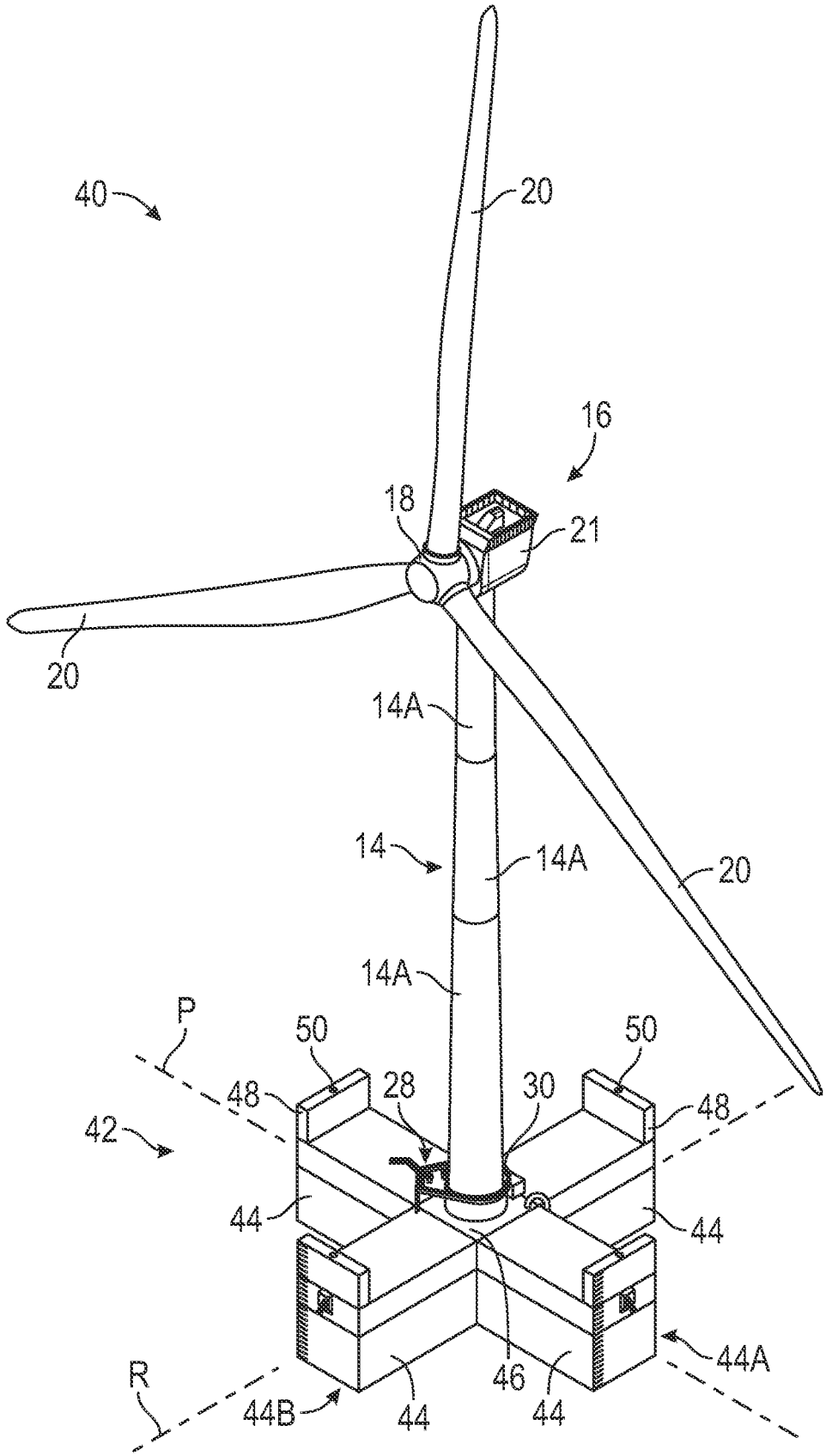
FIG. 4 is a perspective view of a second embodiment of the FOWT platform in accordance with this invention and shown with a wind turbine and wind turbine tower mounted thereon.
Figure 5:
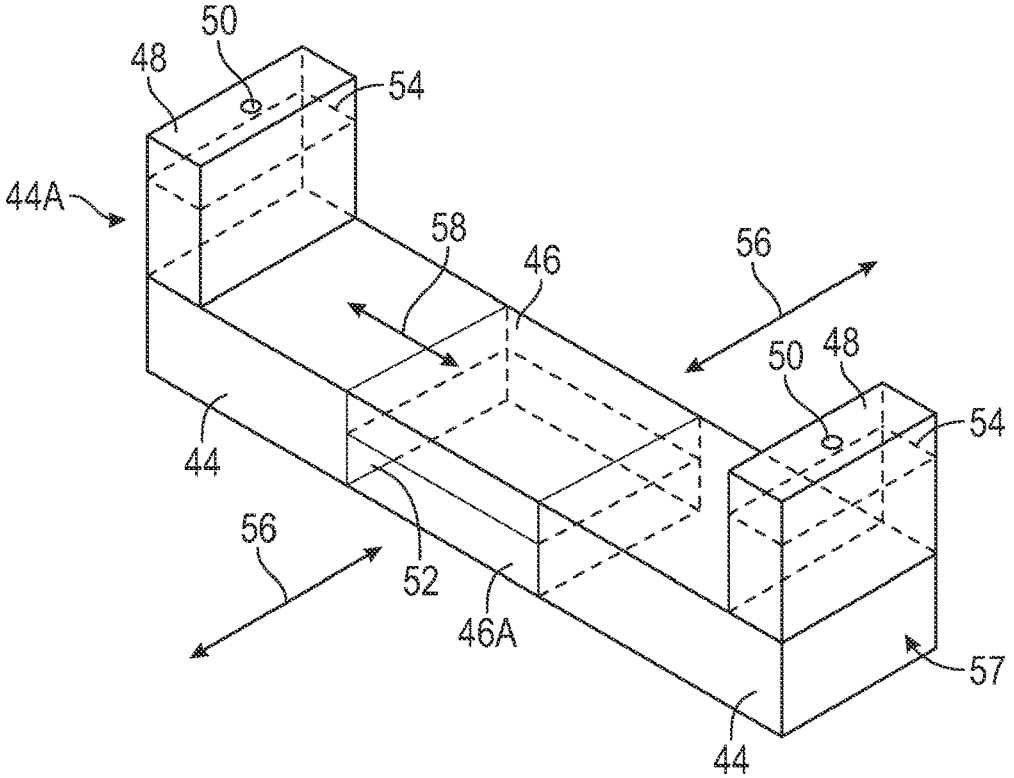
FIG. 5 is a perspective view of a first portion of the FOWT platform illustrated in FIG. 4 showing a first fluid flow conduit.
Figure 6:
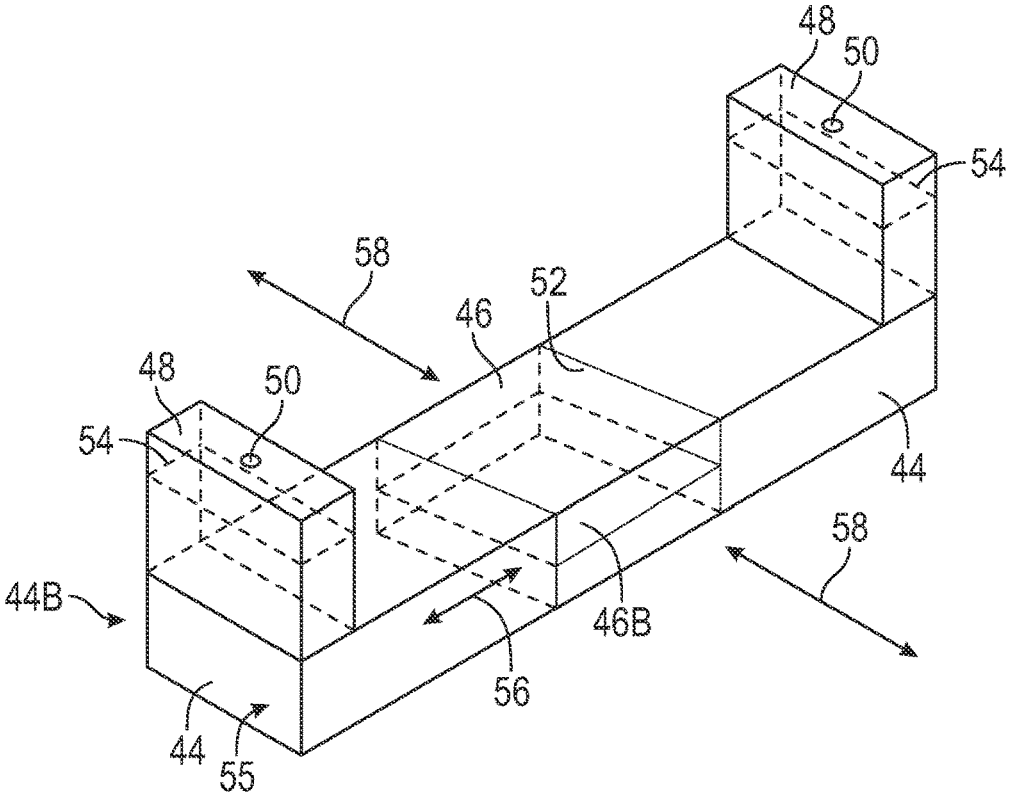
FIG. 6 is a perspective view of a second portion of the FOWT platform illustrated in FIG. 4 showing a second fluid flow conduit.

Referring now to FIGS. 4 through 6, a second embodiment of the FOWT platform in accordance with this invention is shown generally at 40. The FOWT platform 40 is similar to the FOWT platform 10 and includes a foundation 42 that supports the wind turbine 16 mounted on the wind turbine tower 14, as described above. The foundation 42 is a barge-type platform, and is structured and configured to float in a body of water. Accordingly, a portion of the foundation 42 will be above water when the foundation 42 is floating in the water. Mooring lines (not shown) may be attached to the FOWT platform 40 and further attached to anchors (not shown) in the seabed to limit to movement of the FOWT platform 40 on the body of water.

The illustrated foundation 42 may be formed from four bottom beams 44 that extend radially outwardly from the keystone 46 and provide buoyancy. When assembled together, the bottom beams 44 and the keystone 46 define the foundation 42 having a cruciform shape, i.e., having the shape of a cross. As described above, the keystone 46 supports the tower 14. The tower 14 may be mounted to the keystone 46 via the transition member 26.

If desired, the work platform 28 may be mounted at a base of the tower 14, and may include the access-ways or catwalks 30 mounted around all or a portion of the base of the tower 14 and/or the work platform 28. The keystone 46 and the bottom beams 44 may be formed and assembled as described above.

As shown in FIGS. 4 through 6, the keystone 46 includes a first fluid flow conduit 46A formed in a lower portion thereof, and a second fluid flow conduit 46B formed in an upper portion thereof.

Similar to the FOWT platform 10, each bottom beam 44 includes an outwardly extending portion 48 at a distal end thereof (upwardly extending when viewing FIGS. 4 through 6). An upwardly facing wall of each outwardly extending portion 48 includes an opening 50 that extends between an interior of the outwardly extending portion 48 and the atmosphere outside of the outwardly extending portion 48.

A first pair of the bottom beams 44A is shown in FIG. 5 and includes two bottom beams 44 connected to opposite sides of the keystone 46, and a second pair of the bottom beams 44B is shown in FIG. 6 and includes two bottom beams 44 connected to opposite sides of the keystone 46 and having a longitudinal axis perpendicular to a longitudinal axis of the first pair of the bottom beams 44A. The pairs of bottom beams 44A, 44B including the keystone 46 connected therebetween, are generally hollow and define a generally U-shaped ballast conduit 52 that extends between the outwardly extending portions 48 of each bottom beam 44 of each pair of bottom beams 44A, 44B. The ballast conduits 36 52, and the respective fluid flow conduits 46A and 46B, define heel tank dampers 55 and 57.

As shown in FIGS. 5 and 6, each ballast conduit 52 is filled with ballast water, such as sea water. The lines 54 indicate a ballast water level with each outwardly extending portion 48. Because each of the outwardly extending portion 48 includes the opening 50 that is open to the atmosphere outside of the foundation 42, ballast water with the pairs of bottom beams 44A, 44B may move up or down within the outwardly extending portions 48 when the FOWT platform 40 is caused to move such as due to heel motion, turbine harmonic loading, or wave environment loading.

Referring again to FIGS. 5 and 6, the keystone 46 includes the first fluid flow conduit 46A and the second fluid flow conduit 46B formed therein. The first fluid flow conduit 46A is configured to allow ballast water to flow within the ballast conduit 52 of the second pair of bottom beams 44B as shown by the arrows 56. Similarly, the second fluid flow conduit 46B is configured to allow ballast water to flow within the ballast conduit 52 of the first pair of bottom beams 44A as shown by the arrows 58. As shown, the ballast conduit 52 within the pair of bottom beams 44A is not fluidly connected to the ballast conduit 52 within the pair of bottom beams 44B. Thus, ballast water is housed in separated/overlapping fore to aft and side to side conduits, specifically the fluid flow conduits 46A and 46B, arranged in an advantageous cross-tank configuration.

Advantageously, the FOWT platform 40 having the heel tank dampers 55 and 57 is configured such that the ballast water defines a mass element within the cruciform shape of the foundation 42 and the heel tank dampers 55 and 57 allow the foundation 42 to effectively operate with rigid body heel natural frequencies within its intended wave energy range. As used herein, rigid body heel natural frequencies are those frequencies associated with any combination of rigid body pitch or roll motion.

Additionally, the heel tank dampers 55 and 57 use the ballast water as a mass element that is arranged in a cross-tank configuration that allows for effective response mitigation about both pitch P and roll R axes of the foundation 42, as shown in FIG. 4.

Figure 7:
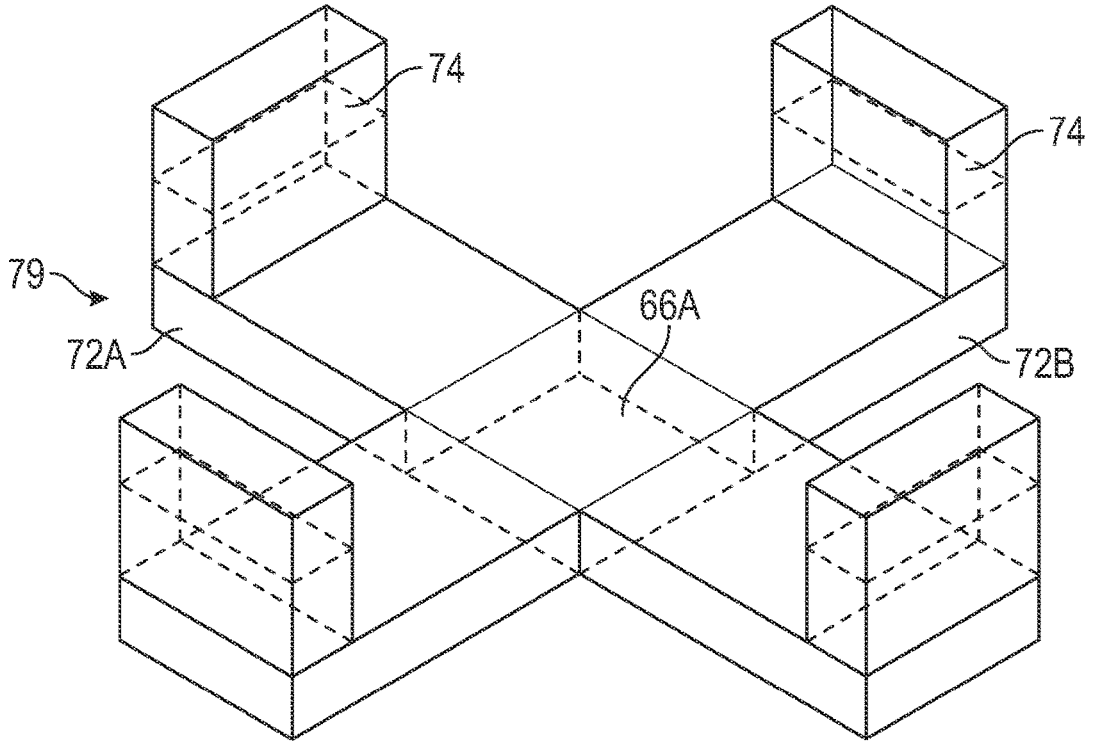
FIG. 7 is a schematic perspective view of a ballast conduit within a third embodiment of the FOWT platform in accordance with this invention.
Figure 8:
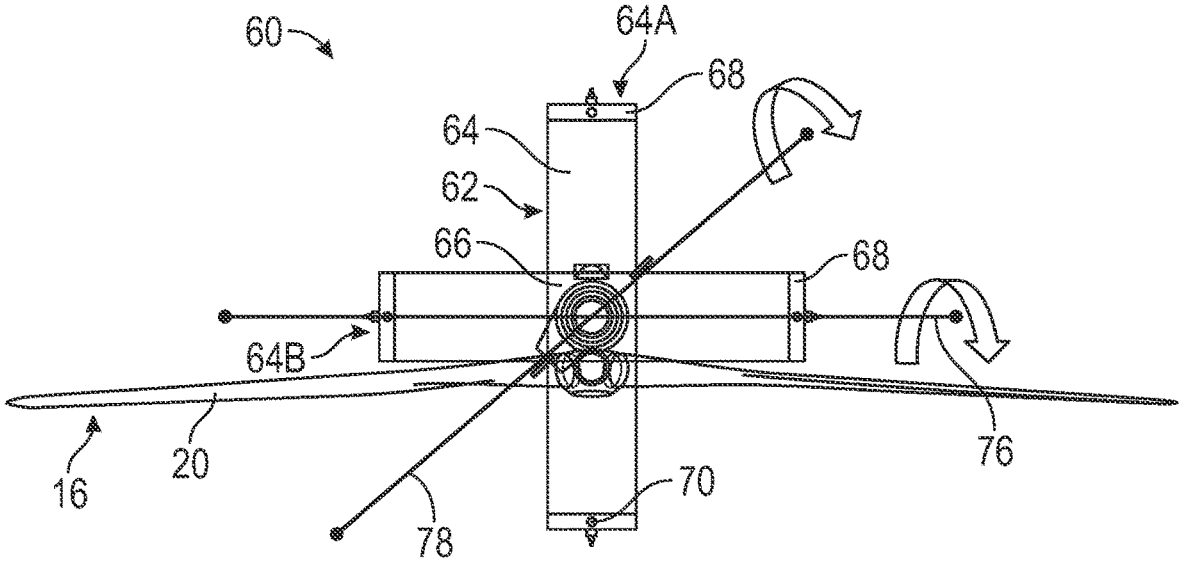
FIG. 8 is a top plan view of the FOWT platform illustrated in FIG. 7.

Referring now to FIGS. 7 and 8, a third embodiment of the FOWT platform in accordance with this invention is shown generally at 60. Specifically, FIG. 7 is a schematic perspective view of a heel tank damper 79 within the FOWT platform 60. The FOWT platform 60 is similar to the FOWT platforms 10 and 40 and includes a foundation 62 that supports the wind turbine 16 mounted on the wind turbine tower 14, as described above. The foundation 62 is barge-type, and is structured and configured to float in a body of water. Accordingly, a portion of the foundation 62 will be above water when the foundation 62 is floating in the water. Mooring lines (not shown) may be attached to the FOWT platform 60 and further attached to anchors (not shown) in the seabed to limit to movement of the FOWT platform 60 on the body of water.

The illustrated foundation 62 may be formed from four bottom beams 64 that extend radially outwardly from the keystone 66 and provide buoyancy. When assembled together, the bottom beams 64 and the keystone 66 define the foundation 62 having a cruciform shape, i.e., having the shape of a cross. As described above, the keystone 66 supports the tower 14. The tower 14 may be mounted to the keystone 66 via the transition member 26.

If desired, the work platform 28 may be mounted at a base of the tower 14, and may include the access-ways or catwalks 30 mounted around all or a portion of the base of the tower 14 and/or the work platform 28. The keystone 66 and the bottom beams 64 may be formed and assembled as described above.

Similar to the FOWT platforms 10 and 40, each bottom beam 64 includes an outwardly extending portion 68 at a distal end thereof (upwardly extending when viewing FIG. 7). An upwardly facing wall of each outwardly extending portion 68 includes an opening 70 that extends between an interior of the outwardly extending portion 68 and the atmosphere outside of the outwardly extending portion 68.

A first pair of the bottom beams 64A includes two bottom beams 64 connected to opposite sides of the keystone 66, and a second pair of the bottom beams 64B includes two bottom beams 64 connected to opposite sides of the keystone 66 and having a longitudinal axis perpendicular to a longitudinal axis of the first pair of the bottom beams 64A. The pairs of bottom beams 64A, 64B, including the keystone 66 connected therebetween, are generally hollow and define a generally U-shaped ballast conduits 72A and 72B, respectively, that extend between the outwardly extending portions 68 of each bottom beam 64 of each pair of bottom beams 64A, 64B.

As shown in FIG. 7, each ballast conduit 72A, 72B is filled with ballast water, such as sea water. The lines 74 indicate a ballast water level with each outwardly extending portion 68. Because each of the outwardly extending portions 68 includes the opening 70 that is open to the atmosphere outside of the foundation 62, ballast water with the pairs of bottom beams 64A, 64B may move up or down within the outwardly extending portions 68 when the FOWT platform 60 is caused to move such as due to heel motion, turbine harmonic loading, or wave environment loading. Unlike the FOWT platform 40 however, the ballast conduits 72A and 72B intersect and are fluidly connected within an interior of the keystone 66A, and define the heel tank damper 79. Thus, ballast water is housed in the intersecting fore to aft and side to side ballast conduits 72A and 72B, arranged in an advantageous cross-tank configuration.

FIG. 8 is a top plan view of the FOWT platform 60 having the foundation 62 shown in FIG. 7. Advantageously, in such an embodiment of the foundation 62 wherein the ballast conduits 72A and 72B intersect and are connected within an interior of the keystone 66, the foundation 62 will experience equivalent damper responses for dynamic heeling about any direction of heel. Such equivalent damper responses will result when the foundation 62 experiences 0 degree rotation, i.e., rotation about the longitudinal axis of either of the pairs of bottom beams 64A, 64B (see line 76 in FIG. 8), or when the foundation 62 experiences 45 degree rotation, i.e., rotation about the line 78 in FIG. 8.

Figure 9:
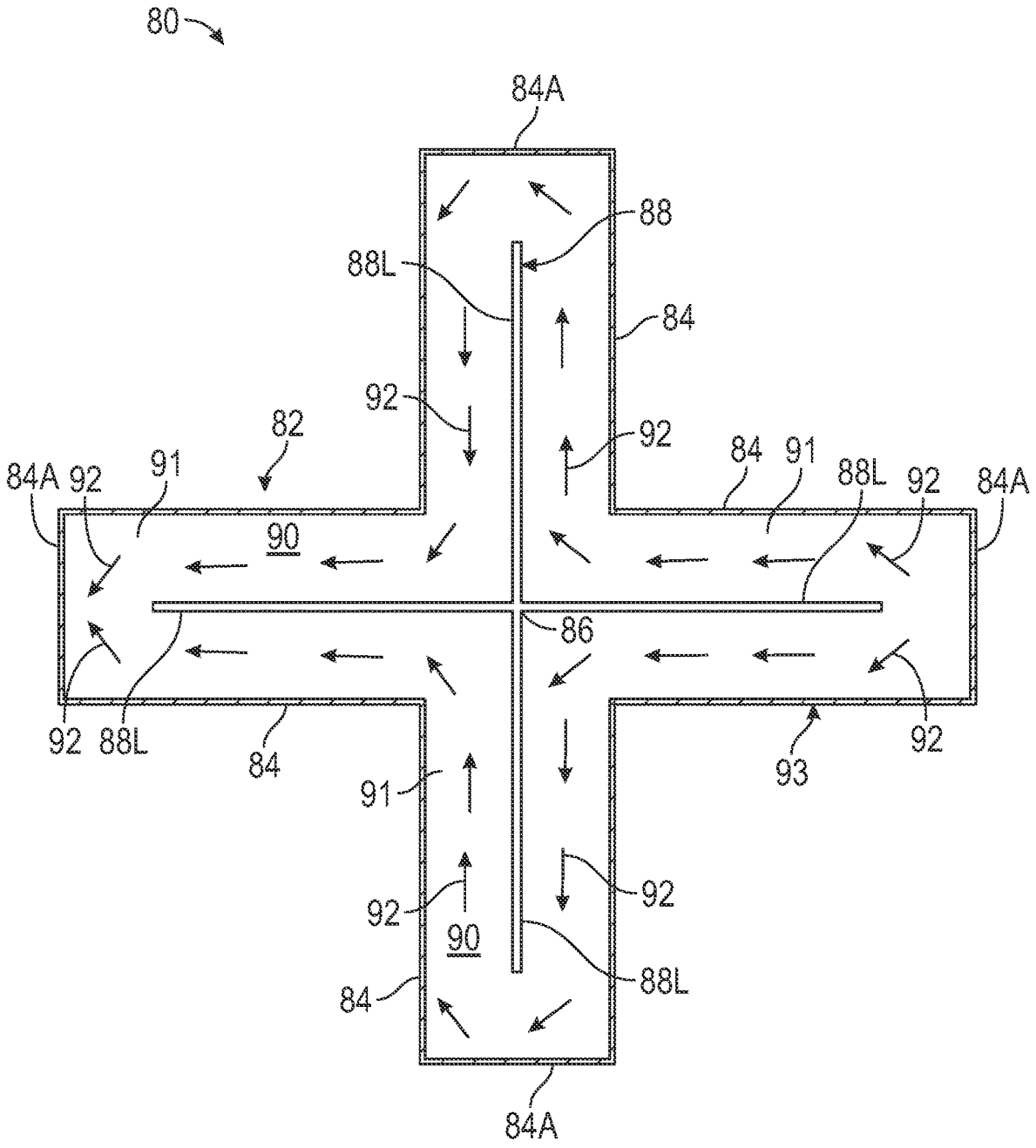
FIG. 9 is a top plan view in cross-section of a fourth embodiment of the FOWT platform in accordance with this invention.

Referring now to FIG. 9, a portion of a fourth embodiment of the FOWT platform in accordance with this invention is shown generally at 80. FIG. 9 is a top plan view in cross-section of the fourth embodiment of the FOWT platform 80 in accordance with this invention. The FOWT platform 80 has an external shape and size similar to the FOWT platform 60 and includes a foundation 82 that supports the wind turbine 16 mounted on the wind turbine tower 14, as described above. The foundation 82 is a barge-type foundation, and is structured and configured to float in a body of water. Accordingly, a portion of the foundation 82 will be above water when the foundation 82 is floating in the water. Mooring lines (not shown) may be attached to the FOWT platform 80 and further attached to anchors (not shown) in the seabed to limit to movement of the FOWT platform 80 on the body of water.

The illustrated foundation 82 may be formed from four bottom beams 84 that extend radially outwardly from central point 86 and provide buoyancy. When assembled together, the bottom beams 84 define the foundation 82 having a cruciform shape, i.e., having the shape of a cross. Additionally, although not shown in FIG. 9, each bottom beam 84 includes an outwardly extending portion 68 at a distal end thereof (upwardly extending when viewing FIG. 7), and the opening 70 that extends between an interior of the outwardly extending portion 68 and the atmosphere outside of the outwardly extending portion 68.

As shown in FIG. 9 a cross shaped wall 88 has four legs 88L and extends vertically between a lower wall or base 90 of each beam 84 and an upper wall (not shown) of each beam 84. The distal ends of each of the legs 88L are spaced apart from distal end walls 84A of each beam 84. The wall 88 defines a unique, integrated heel tank damper 93 having multiple ballast conduits 91, and thus extended fluid flow paths within the foundation 82, i.e., between the wall 88 and the walls of each beam 84. Examples of the extended fluid flow paths are shown by the arrows 92. As shown, the wall 88 increases the length of the ballast conduits 91 relative to the ballast conduits described herein above. The increased length of the ballast conduits 91 allows the heel tank damper 93 natural frequency to be decreased. Advantageously, the natural frequency of the heel tank damper 93 within the foundation 82 may be increased or decreased by changing the lengths of the legs 88L of the wall 88 within each beam 84.

Figure 10:
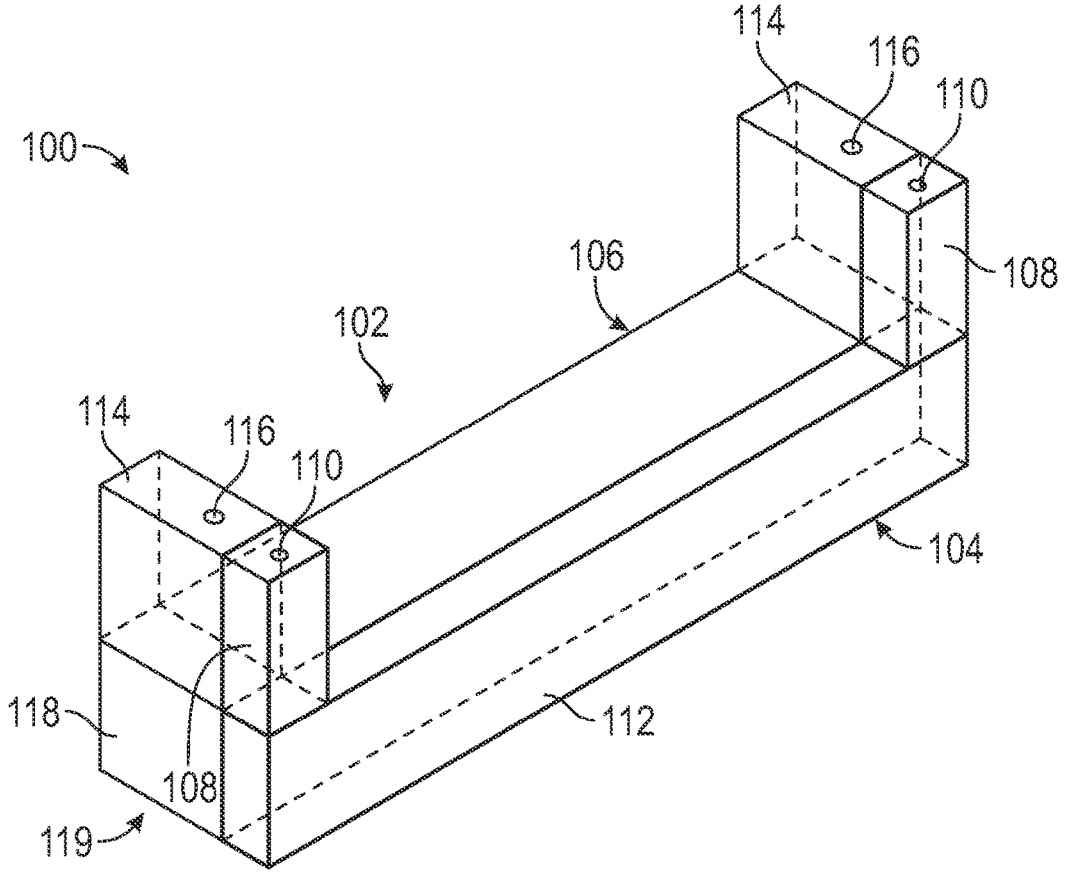
FIG. 10 is a perspective view of one leg of a fifth embodiment of the FOWT platform in accordance with this invention.

Referring now to FIG. 10, a portion of a fifth embodiment of the FOWT platform in accordance with this invention is shown generally at 100. FIG. 10 is a perspective view of one leg 102 of the FOWT platform 100 in accordance with this invention. The FOWT platform 100 has an external shape and size similar to the FOWT platform 80 and includes a foundation (not shown) that supports the wind turbine 16 mounted on the wind turbine tower 14, as described above. The foundation is a barge-type foundation, and is structured and configured to float in a body of water. Accordingly, a portion of the foundation will be above water when the foundation is floating in the water. Mooring lines (not shown) may be attached to the FOWT platform 100 and further attached to anchors (not shown) in the seabed to limit to movement of the FOWT platform 100 on the body of water.

The leg 102 represents one portion of the foundation that will include an additional leg 102 having a longitudinal axis perpendicular to a longitudinal axis of the illustrated leg 102.

The illustrated leg 102 may be formed as one discrete member, or may be formed from two bottom beams (not shown) that extend outwardly from a keystone (not shown but similar to the keystone 66). As described above, the legs 102 provide buoyancy for the foundation. When assembled together, the legs 102 define the foundation having a cruciform shape, i.e., having the shape of a cross.

The leg 102 is formed as two side-by-side tanks, each defining heel tank dampers, including a first tank 104 and a second tank 106. The first tank 104 includes an outwardly extending portion 108 at each distal end thereof (upwardly extending when viewing FIG. 10). An upwardly facing wall of each outwardly extending portion 108 includes an opening 110 that extends between an interior of the outwardly extending portion 108 and the atmosphere outside of the outwardly extending portion 108. An interior of the first tank 104 defines a generally U-shaped ballast conduit 112 that extends between the outwardly extending portions 108 at opposite ends of the first tank 104 and further defines a first heel tank damper. If desired, the ballast conduit 112 may include an internal damping element, such as the damping element 38, at or near a center of the ballast conduit 112.

The second tank 106 is similar to the first tank 104 but is larger than the first tank 104, and includes an outwardly extending portion 114 at each distal end thereof (upwardly extending when viewing FIG. 10). An upwardly facing wall of each outwardly extending portion 114 includes an opening 116 that extends between an interior of the outwardly extending portion 114 and the atmosphere outside of the outwardly extending portion 114. An interior of the second tank 106 defines a generally U-shaped ballast conduit 118 that extends between the outwardly extending portions 114 at opposite ends of the second tank 106 and further defines a second heel tank damper. If desired, the ballast conduit 118 may include an internal damping element, such as the damping element 38, at or near a center of the ballast conduit 112. As shown in FIG. 10, the first tank 104 is mounted adjacent the second tank 106, but are not fluidly connected.

The two legs 102 that are mounted perpendicularly to each other to form the foundation (not shown) are fluidly connected to each other.

The side-by-side ballast conduits 112 and 118 combine to define a heel tank damper 119 configured to allow the ballast conduits 112 and 118 to mitigate different frequencies. In the embodiment illustrated in FIG. 10, the first tank 104 is structured and configured for relatively high frequency responses, and the second tank 106 is structured and configured for relatively low frequency responses.

Figure 11:
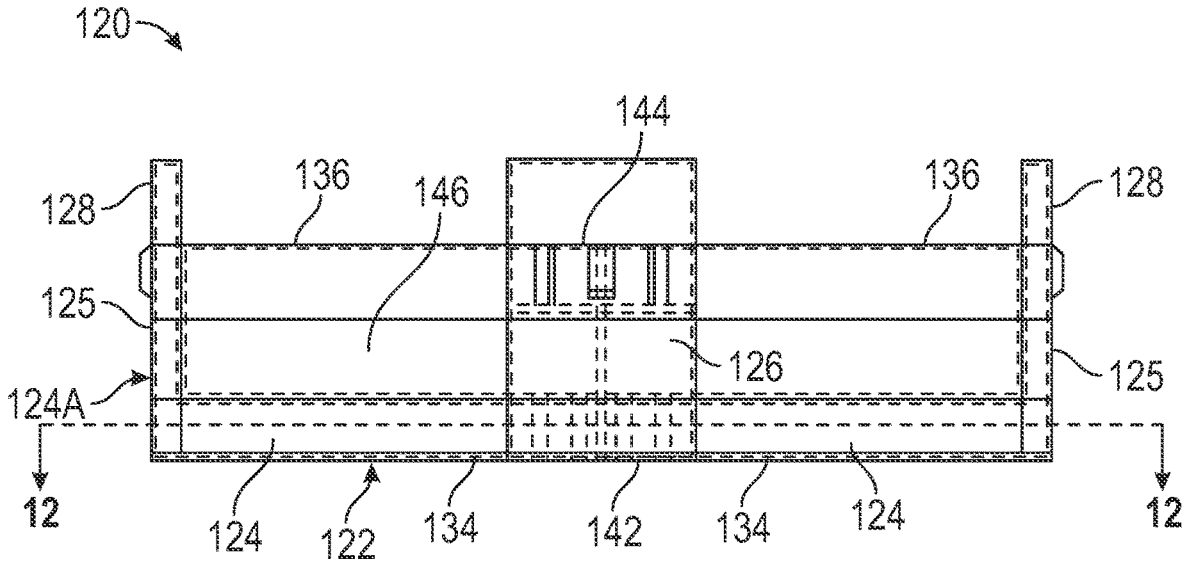
FIG. 11 is a side elevational view in cross-section of a sixth embodiment of the FOWT platform in accordance with this invention.
Figure 12:
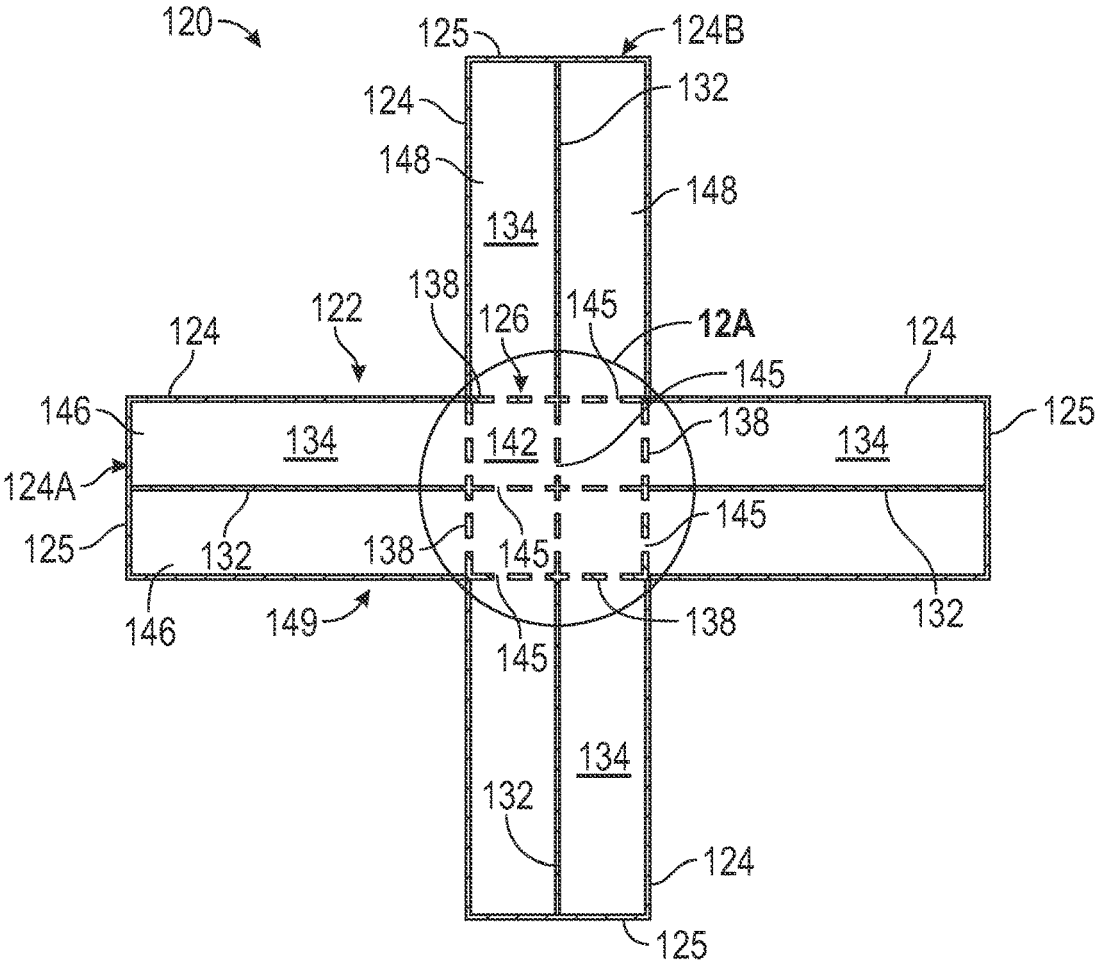
FIG. 12 is a top plan view in cross-section taken along the line 12-12 in FIG. 11.
Figure 12A:
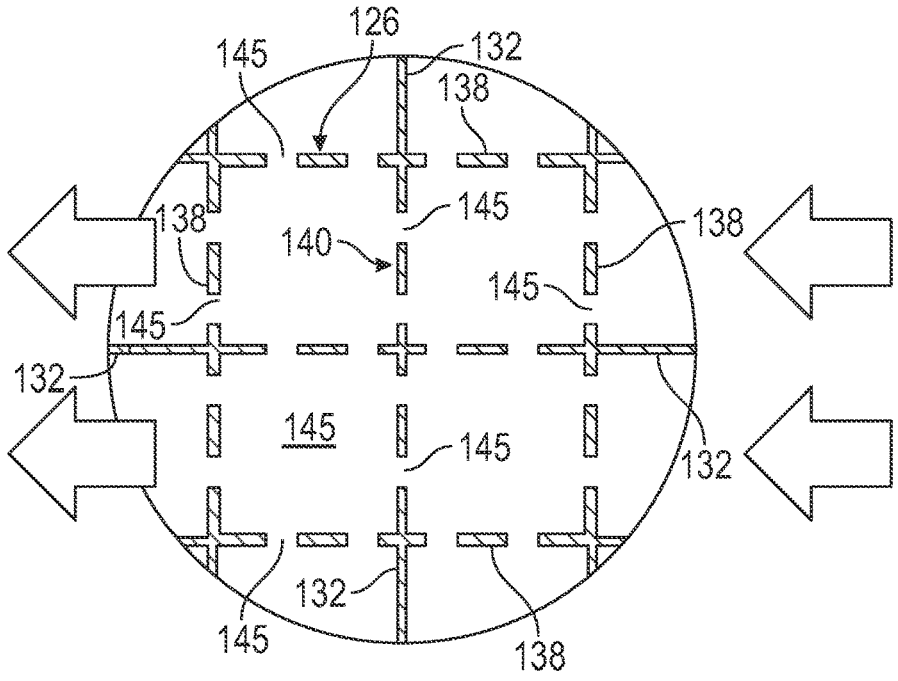
FIG. 12A is an enlarged view of a portion of the FOWT platform illustrated in FIG. 11.

Referring now to FIGS. 11, 12, and 12A, a portion of a sixth embodiment of the FOWT platform in accordance with this invention is shown generally at 120. FIG. 11 is a side elevational view in cross-section of the FOWT platform 120 in accordance with this invention, and FIG. 12 is a top plan view in cross-section of the FOWT platform 120. FIG. 12A is an enlarged view of a portion of the FOWT platform 120.

The FOWT platform 120 has an external shape and size similar to the FOWT platform 60 and includes a foundation 122 that supports the wind turbine 16 mounted on the wind turbine tower 14, as described above. The foundation 122 is a barge-type foundation, and is structured and configured to float in a body of water. Accordingly, a portion of the foundation 122 will be above water when the foundation 122 is floating in the water. Mooring lines (not shown) may be attached to the FOWT platform 120 and further attached to anchors (not shown) in the seabed to limit to movement of the FOWT platform 120 on the body of water.

The illustrated foundation 122 may be formed from four bottom beams 124 that extend radially outwardly from a keystone 126 and provide buoyancy. When assembled together, the bottom beams 124 and the keystone 126 define the foundation 122 having a cruciform shape, i.e., having the shape of a cross. As described above, the keystone 126 supports the tower 14. The tower 14 may be mounted to the keystone 66 via the transition member 26.

Similar to the FOWT platforms 10, 40, and 60 each bottom beam 124 includes an outwardly extending portion 128 at a distal end thereof (upwardly extending when viewing FIG. 11). An upwardly facing wall of each outwardly extending portion 128 includes an opening (not shown, but similar to the opening 70 shown in FIG. 7) that extends between an interior of the outwardly extending portion 128 and the atmosphere outside of the outwardly extending portion 128.

A first pair of the bottom beams 124A includes two bottom beams 124 connected to opposite sides of the keystone 126, and a second pair of the bottom beams 124B includes two bottom beams 124 connected to opposite sides of the keystone 126 and having a longitudinal axis perpendicular to a longitudinal axis of the first pair of the bottom beams 124A. The pairs of bottom beams 124A, 124B, including the keystone 126 connected therebetween, define a plurality of generally U-shaped ballast conduits, described in detail below, that extend between the outwardly extending portions 128 of each bottom beam 124 of each pair of bottom beams 124A, 124B.

Each bottom beam 124 includes an interior wall 132 that extends vertically between a lower wall or base 134 and an upper wall 136 of each bottom beam 124, further extends longitudinally from distal end walls 125 of each bottom beam 124 to a vertically extending exterior wall 138 of the keystone 126, and upwardly into the outwardly extending portion 128 of each bottom beam 124.

The keystone 126 includes a cross-shaped wall 140 that extends vertically between a lower wall or base 142 and an upper wall 144 of the keystone 126. Each leg of the cross-shaped wall 140 is longitudinally aligned with one of the interior walls 132 of the bottom beams 124. The walls 138 and each of the legs of the cross-shaped wall 140 have vertically extending fluid flow openings 145 formed therein, and define an internal damping element.

Thus, as shown in FIGS. 12 and 12A, a plurality of generally U-shaped ballast conduits 146 and 148 extend between the outwardly extending portions 128 of each bottom beam 124 of each pair of bottom beams 124A, 124B, respectively. The combination of the ballast conduits 146 and 148, and the plurality of fluid flow paths defined by the fluid flow openings in the walls 138 and 140 of the keystone 126 define a heel tank damper system 149 that advantageously uses the structure of the ballast conduits 146 and 148 and the flow of ballast water through the fluid flow openings 145 to achieve the desired level of damping.

Figure 13A:
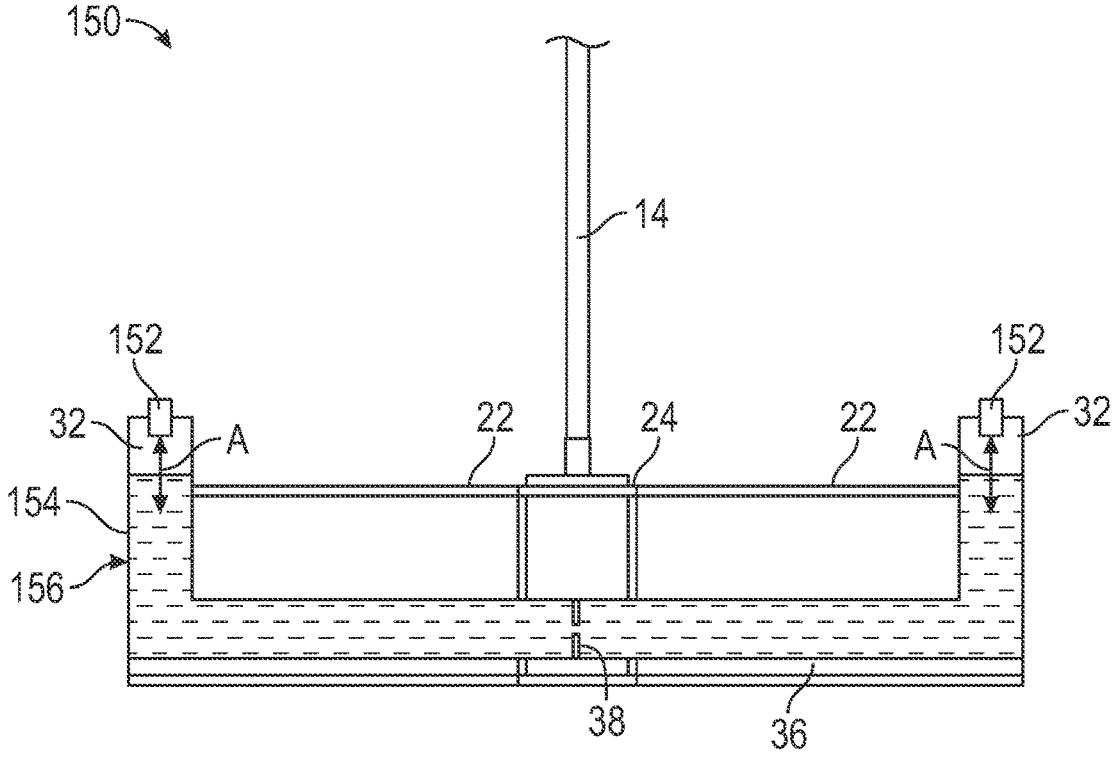
FIG. 13A is a side elevational view in cross-section of one portion of a seventh embodiment of the FOWT platform in accordance with this invention.

Referring now to FIG. 13A, a portion of a seventh embodiment of the FOWT platform in accordance with this invention is shown generally at 150. FIG. 13A is a side elevational view in cross-section of a portion of the FOWT platform 150 in accordance with this invention.

The FOWT platform 150 is substantially the same as the FOWT 10, and includes the keystone 24 and the bottom beams 22 that may be assembled and post-tensioned longitudinally to define the pair of bottom beams 154, as shown in FIG. 13A. Although not illustrated, the FOWT platform 150 includes a second pair of bottom beams, substantially the same as the pair of bottom beams 154. The pair of bottom beams 154 also includes an external damping element 152 mounted in the upwardly facing wall of each outwardly extending portion 32 in lieu of the opening 34 of the FOWT 10. The external damping element 152 may be any desired type of damping element, including but not limited to a fixed opening through the upwardly facing wall of each outwardly extending portion 32, a movable or otherwise adjustable orifice therethrough, a gate valve, and any other valve or structure that controls the flow of air between the interior of the outwardly extending portion 32 and the atmosphere outside of the outwardly extending portion 32.

Thus, the combination of the ballast conduit 36, internal damping element 38, and the external damping element 152 define an integrated heel tank damper 156. The FOWT platform 150, and each of the embodiments of the FOWT platform described herein, may include any desired number of sensors, such as position, movement, and environmental condition sensors (not shown), and includes a controller, such as a computer, configured operate and monitor the sensors and to adjust any of the valve, pumps, orifices, and the like within the FOWT platform.

Advantageously, the response of the integrated heel tank dampers described herein, for example the integrated heel tank damper 156, may be set, tuned, and/or adjusted actively or passively via adjustments to the heel tank damper's 156 mass, or damping. As used herein, stiffness may be defined as any restoring force acting on the heel tank damper with the effect of returning the heel tank damper to its equilibrium position.

For example, the heel tank damper 156 may be actively or passively tuned by adjusting one or both of the external damping element 152 and the internal damping element 38.

Figure 13B:
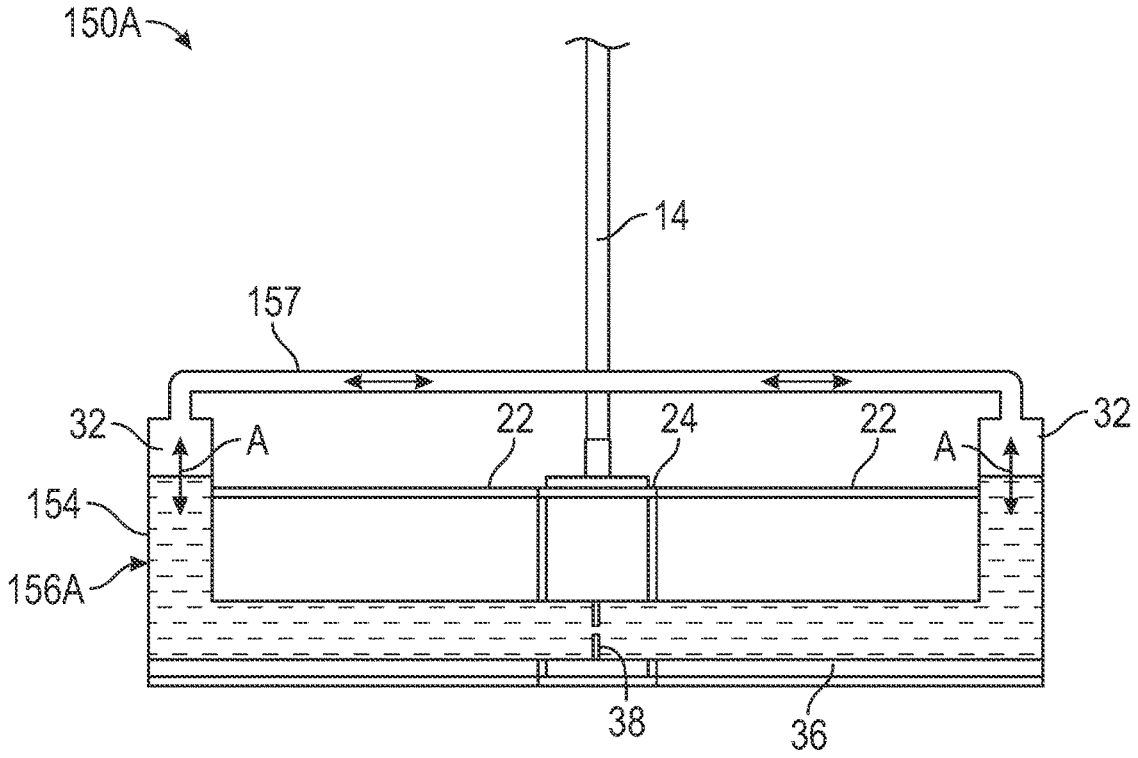
FIG. 13B is a side elevational view in cross-section of one portion of an alternate embodiment of the FOWT platform illustrated in FIG. 13A.

FIG. 13B is a side elevational view in cross-section of one portion of an alternate embodiment of the FOWT platform 150 illustrated in FIG. 13A. The FOWT platform 150A illustrated in FIG. 13B is similar to the FOWT platform 150, but does not include the external damping elements 152. Rather, the FOWT platform 150A includes an air duct, shown schematically at 157 that extends between each outwardly extending portion 32 of the pair of bottom beams 154. Thus, the combination of the ballast conduit 36, internal damping element 38, and the air duct 157 define an integrated heel tank damper 156A.

The volume of air within each outwardly extending portion 32 of the pair of bottom beams 154 are therefore fluidly connected by the air duct 157, thus providing a bi-modal heel tank response from venting or cross-talk between the volume of air within each outwardly extending portion 32.

Figure 15:
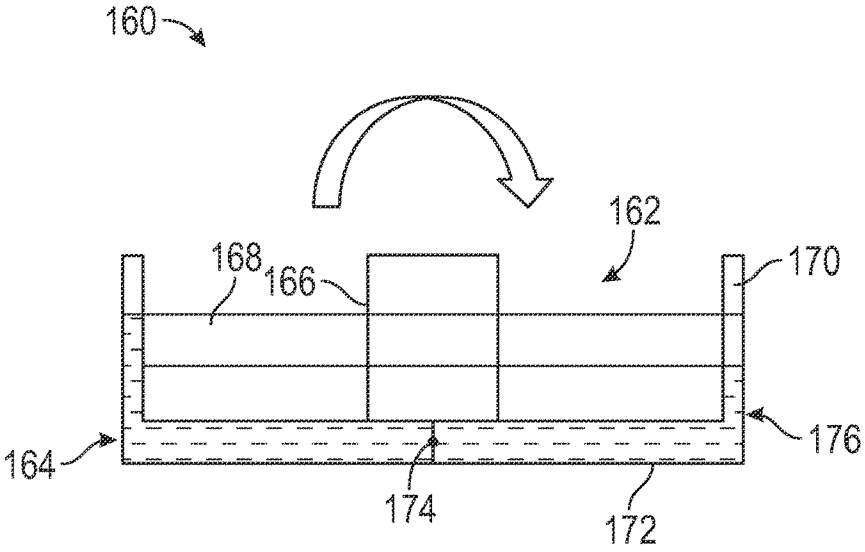
FIG. 15 is a side elevational view in cross-section of the FOWT platform illustrated in FIG. 14 shown in a second position.
Figure 14:
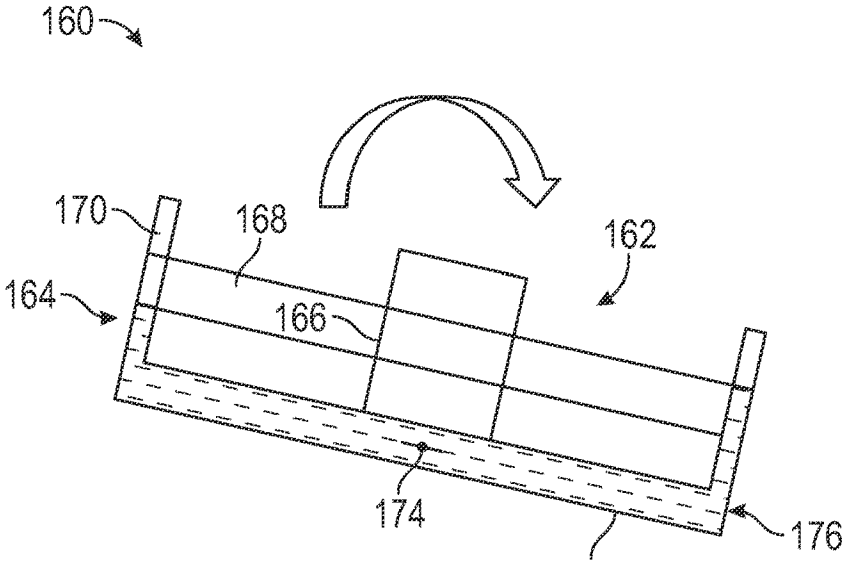
FIG. 14 is a side elevational view in cross-section of an eighth embodiment of the FOWT platform in accordance with this invention shown in a first position.

Referring now to FIGS. 14 and 15, cross-sectional views of an eighth embodiment of the FOWT platform in accordance with this invention, and similar to the FOWT platforms 10 and 150, is shown generally at 160. FIG. 14 is a cross-sectional side elevational view of the FOWT platform 160 shown in a first position, and FIG. 15 is a cross-sectional side elevational view of the FOWT platform 160 illustrated a second position.

The FOWT platform 160 includes a foundation 162 having two pairs of bottom beams, one of which is illustrated at 164. The pair of bottom beams 164 includes a keystone 166 and two bottom beams 168 that may be assembled and post-tensioned longitudinally, as shown in FIGS. 14 and 15.

When assembled together, the two pairs of bottom beams 164 and the keystone 166 define the foundation 162 having a cruciform shape, i.e., having the shape of a cross. As described above, the keystone 166 supports the tower 14. The tower 14 may be mounted to the keystone 166 via the transition member 26.

Similar to the FOWT platforms 10, 40, and 60 each bottom beam 164 includes an outwardly extending portion 170 at a distal end thereof (upwardly extending when viewing FIGS. 14 and 15). An upwardly facing wall of each outwardly extending portion 170 may include an opening (not shown, but similar to the opening 70 shown in FIG. 7) that extends between an interior of the outwardly extending portion 170 and the atmosphere outside of the outwardly extending portion 170. Additionally, the foundation 162 may include the external damping elements 152, or an air conduit (not shown) between the two outwardly extending portions 170 and allows for the movement of air therebetween.

A generally U-shaped ballast conduit 172 is defined within the pair of bottom beams 164 and extends between the outwardly extending portions 170 of each bottom beam 164 of each pair of bottom beams 164. The ballast conduit 172 includes an internal damping element 174 at or near a center of the ballast conduit 172. The ballast conduit 172 is filled with ballast water, such as sea water. The internal damping element 174 may be any desired damping element, including but not limited to a gate valve, and a wall or partition having a movable or otherwise closable orifice therethrough. The ballast conduits 172 and their respective internal damping elements 174 define a heel tank damper 176.

FIG. 14 illustrates the movement of water within the heel tank damper 176 when the gate valve 174 is in an open position, such as during movement of the FOWT platform 160 due to waves. FIG. 15 illustrates the FOWT platform 160 with the gate valve 174 in a closed position and wherein a larger portion of the ballast water is in one half of the heel tank damper 176 (the left half when viewing FIG. 15), thereby righting the FOWT platform 160 and mitigating the effect of the external moment of the FOWT platform 160. It will be understood that the gate valve 174 may be actively or passively opened and closed. Advantageously, the FOWT platform 160 may be righted under external moments via the closing and opening of the gate valve 176. For example, when ballast water within the ballast conduit 172 has moved to a desired position, such as when a larger portion of the ballast water is in one half of the heel tank damper 176, and the FOWT platform 160 has been righted, as shown in FIG. 15, the valve 174 may be closed, allowing the FOWT platform 160 to be balanced while floating.

The heel tank damper's 176 frequency response may be actively or passively tuned by adjusting the total mass of the damper heel tank damper 176, for example by adding or removing ballast water.

One or both of the internal damping element 38 and the external damping elements 152 may be actively or passively tuned to:

(1) respond to period ranges, i.e., waves having 5 to 19 second peak wave periods, and (2) respond to period ranges, i.e., wherein the natural period Tn of the pitch and roll is greater than about 20 seconds.

FOWT platform system response may be actively or passively monitored to identify and actively tune the heel tank damper, such as the heel tank damper 176, to mitigate effects from wave excitation, heel response, bending tower, or any other undesired system dynamics.

It will be understood that any of the embodiments of the FOWT platforms described herein may be used in combination with one or more external sensors, such as on a wave buoy (not shown). Thus, the heal tank damper's set points, such as the heel tank damper 176, may be actively tuned based on external measurements received from the wave buoy. Additional external sensors may also be provided on the FOWT platform, such as the FOWT platform 160.

Figure 16:
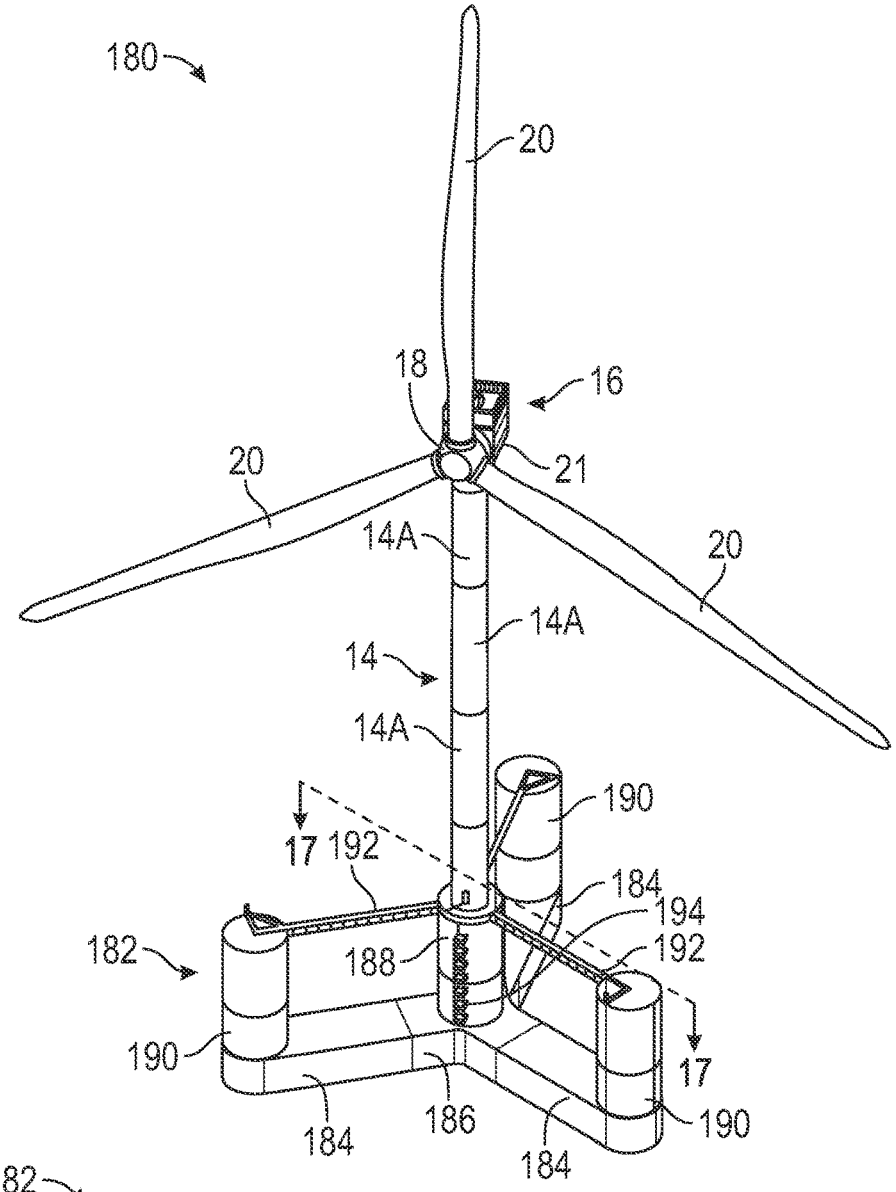
FIG. 16 is a perspective view of a nineth embodiment of the FOWT platform in accordance with this invention and shown with a wind turbine and wind turbine tower mounted thereon.
Figure 17:
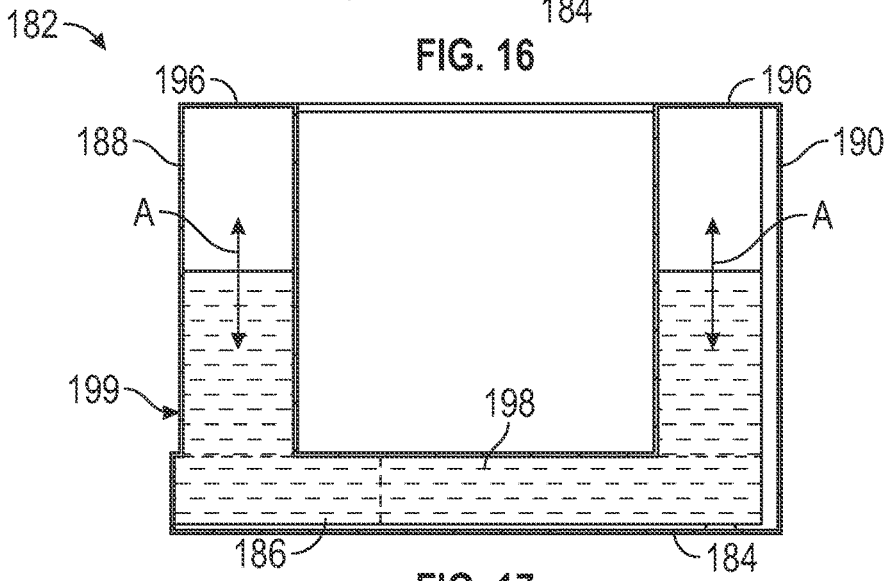
FIG. 17 is a cross-sectional view taken along the line 17-17 in FIG. 16.

Referring now to FIGS. 16 and 17, a ninth embodiment of the FOWT platform in accordance with this invention is shown generally at 180. The FOWT platform 180 includes a foundation 182 that supports the wind turbine 16 mounted on the wind turbine tower 14, as described above. The foundation 182 is semi-submersible, and is structured and configured to float, semi-submerged, in a body of water. Accordingly, a portion of the foundation 182 will be above water when the foundation 182 is floating in the water. Mooring lines (not shown) may be attached to the FOWT platform 180 and further attached to anchors (not shown) in the seabed to limit to movement of the FOWT platform 180 on the body of water.

The illustrated foundation 182 is formed from three bottom beams 184 that extend radially outwardly from a keystone 186 and provide buoyancy. When assembled together, the bottom beams 184 and the keystone 186 define the foundation 182. An interior or center column 188 is mounted to the keystone 186, and three outer columns 190 are mounted at or near the distal ends of the bottom beams 184. The center column 188 and the outer columns 190 extend outwardly (upwardly when viewing FIGS. 16 and 17) and perpendicularly to the bottom beams 184, and also provide buoyancy. Axes of the center column 188 and the outer columns 190 are also substantially parallel. Additionally, the center column 188 supports the tower 14. The bottom beams 184, the keystone 186, and the columns 188 and 190 may be formed as described herein above.

Access-ways or catwalks 192 extend radially from, and are connected to, the center column 188, and are also connected to each of the outer columns 190. Access ladders 194 may mounted to one or more of the center column 188 and the outer columns 190.

If desired, support members or top beams (not shown) may extend radially from, and be connected to, the center column 188 and to each of the outer columns 190. When top beams are provided, the catwalks 192 may be mounted thereon.

An upwardly facing wall of each the center column 188 and the outer columns 190 may include an opening 196 that extends between an interior of the columns 188, 190 and the atmosphere outside of the columns 188, 190.

The columns 188, 190, the keystone 186, then the bottom beams 184 are generally hollow. The space within the center column 188, each outer column 190, the keystone 186, and the bottom beam 184 therebetween define a generally U-shaped ballast conduit 198. The combination of the three ballast conduits 198, defined by the three outer columns 190, the three bottom beams 184, the keystone 186, and the center column 188, define a heel tank damper 199. It will be understood that one or more of the keystone 186 and the bottom beams 184 may include any of the damper elements described herein above.

As shown in FIG. 17, each ballast conduit 198 is filled with ballast water, such as sea water. Because each of the columns 188, 190 includes the opening 196 that is open to the atmosphere outside of the foundation 182, ballast water within the columns 188, 190 moves up or down within the columns 188, 190, as shown by the arrows A, when the FOWT platform 182 is caused to move such as due to heel motion, turbine harmonic loading, or wave environment loading.

It will be understood that the embodiments of the heel tank dampers described and illustrated herein may be integrally formed within any desired FOWT platform foundation, including, but not limited to a tension leg platform (TLP), barge, spar, semi-submersible, or hybrid concept such that mass consists of water ballast provided within the foundation or hull structure which is allowed to oscillate within a ballast conduit, such as shown by the arrows A in FIG. 17.

Advantageously, a barge-type FOWT platform foundation, such as shown in FIGS. 16 and 17 uses ballast water as the mass element in a tuned mass damper (TMD) to mitigate design driving responses. Additionally, a TMD that uses ballast water as a mass element, such as the heel tank damper 199, may be provided in an existing barge-type FOWT platform foundation or hull design to mitigate unwanted dynamic responses from heel motion, turbine harmonic loading, and/or wave environment loading. Further, a TMD that uses ballast water as a mass element, such as the heel tank damper 199, may be provided in an existing barge-type FOWT platform foundation or hull design, wherein the TMD allows the barge-type platform foundation or hull to effectively operate with rigid body heel natural frequencies within its intended wave energy range, and in the presence of additional external damping in the form of viscous drag loading on the foundation or hull.

Figure 18:
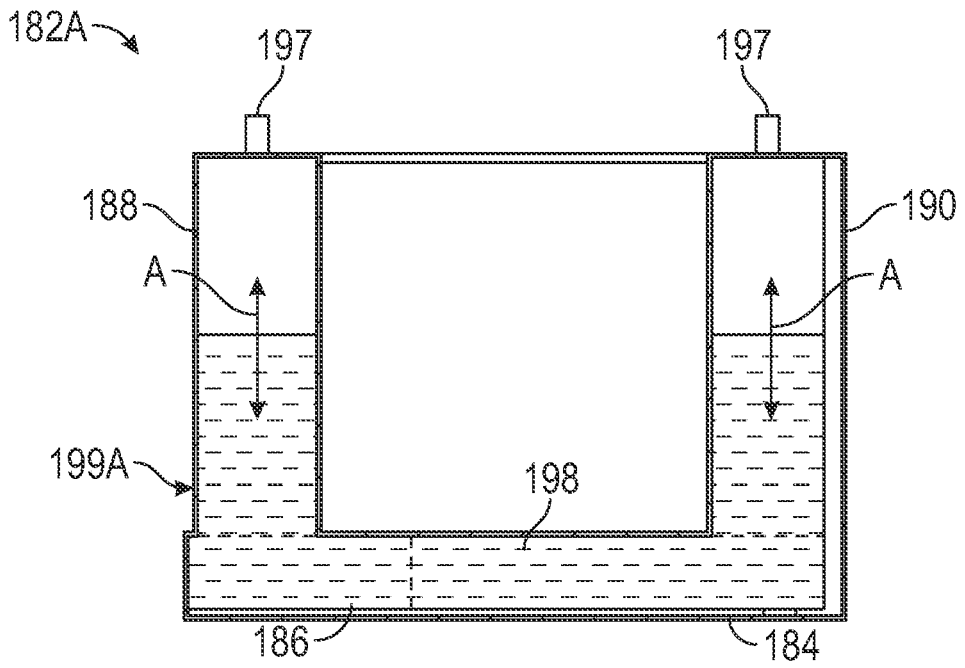
FIG. 18 is a cross-sectional view of an alternate embodiment of the FOWT platform illustrated in FIGS. 16 and 17.

FIG. 18 is a cross-sectional view of an alternate embodiment of the foundation 182 illustrated in FIG. 17. The foundation 182A illustrated in FIG. 18 is similar to the foundation 182, but does not include the openings 196. Rather, the foundation 182A includes external damping elements 197 mounted in the upwardly facing walls of the center column 188 and the outer columns 190. The external damping elements 197 may be any desired type of damping element, including but not limited to a fixed opening through the upwardly facing wall of each of the center column 188 and the outer columns 190, a movable or otherwise adjustable orifice therethrough, a gate valve, and any other valve or structure that controls the flow of air between the interior of the center column 188 and the outer columns 190 and the atmosphere outside of the center column 188 and the outer columns 190. The combination of the three ballast conduits 198, defined by the three outer columns 190, the three bottom beams 184, the keystone 186, and the center column 188, define a heel tank damper 199A. It will be understood that one or more of the keystone 186 and the bottom beams 184 may include any of the damper elements described herein above.

Figure 19:
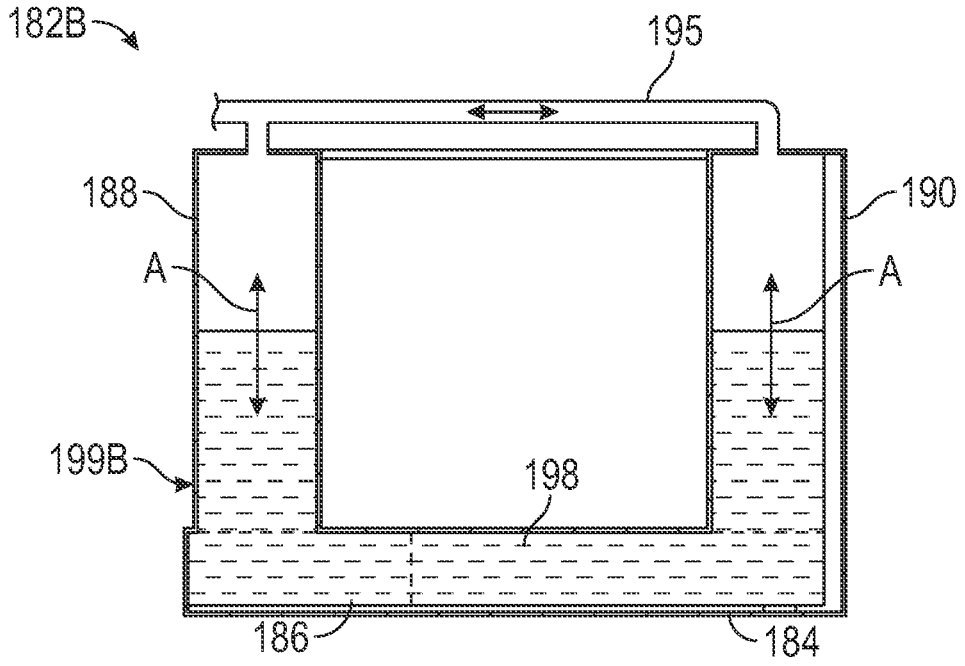
FIG. 19 is a cross-sectional view of an additional alternate embodiment of the FOWT platform illustrated in FIGS. 16, 17, and 18.

FIG. 19 is a cross-sectional view of an alternate embodiment of the foundation 182 illustrated in FIGS. 17 and 18. The foundation 182B illustrated in FIG. 19 is similar to the foundation 182A, but does not include the external damping elements 197. Rather, the FOWT platform 182B includes an air duct, shown schematically at 195 that extends between each outer column 190 and the center column 188. The combination of the three ballast conduits 198, defined by the three outer columns 190, the three bottom beams 184, the keystone 186, and the center column 188, define a heel tank damper 199B. It will be understood that one or more of the keystone 186 and the bottom beams 184 may include any of the damper elements described herein above.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A wind turbine platform capable of floating on a body of water and supporting a wind turbine thereon in combination with a heel tank damper comprising:

a wind turbine platform including:

a keystone;

a first pair bottom beams including two bottom beams connected to opposite sides of the keystone;

a second pair of bottom beams including two bottom beams connected to opposite sides of the keystone, wherein the second pair of bottom beams has a longitudinal axis perpendicular to a longitudinal axis of the first pair of the bottom beams, wherein the keystone, the first pair of bottom beams, and the second pair of bottom beams define a foundation;

wherein each bottom beam in the first and second pairs of bottom beams includes an outwardly extending portion at a distal end thereof; and wherein a U-shaped ballast conduit is one of mounted and formed within each of the first pair of bottom beams and the second pair of bottom beams, and extends between the outwardly extending portions of each bottom beam of each of the first and second pairs of bottom beams;

wherein the U-shaped ballast conduits have ballast water therein, the ballast water extending from the outwardly extending portions of each bottom beam of each of the first and second pairs of bottom beams, such that a volume of air is defined between a surface of the ballast water in each outwardly extending portion and an outwardly facing wall of each outwardly extending portion; and an internal damping element within the U-shaped ballast conduits; and a heel tank damper defined by the U-shaped ballast conduits and the internal damping element therein.

2. The wind turbine platform in combination with the heel tank damper according to claim 1, wherein the first and second pairs bottom beams define a foundation having a cruciform shape.

3. The wind turbine platform in combination with the heel tank damper according to claim 1, wherein the outwardly facing wall of each outwardly extending portion includes an opening that extends between an interior of the outwardly extending portion and the atmosphere outside of the outwardly extending portion.

4. The wind turbine platform in combination with the heel tank damper according to claim 1, wherein the internal damping element is one of a wall having an orifice therethrough, a wall having a movable orifice therethrough, and a gate valve.

5. The wind turbine platform in combination with the heel tank damper according to claim 1, wherein the internal damping element is configured to control the flow of ballast water between the bottom beams of each of the first pair of bottom beams and the second pair of bottom beams.

6. The wind turbine platform in combination with the heel tank damper according to claim 1, wherein an outwardly facing wall of each outwardly extending portion includes an external damping element mounted thereto.

7. The wind turbine platform in combination with the heel tank damper according to claim 6, wherein the external damping element is one of a wall having an orifice therethrough, a wall having a movable orifice therethrough, and a gate valve, and is configured to control the flow of air between an interior of the outwardly extending portion and the atmosphere outside of the outwardly extending portion.

8. The wind turbine platform in combination with the heel tank damper according to claim 1, further including an air duct that extends between each outwardly extending portion of each pair of bottom beams, the air duct fluidly connecting the volume of air within each outwardly extending portion of each pair of bottom beams, the air duct configured to provide a bi-modal heel tank response from venting between a volume of air within each outwardly extending portion.

9. The wind turbine platform in combination with the heel tank damper according to claim 1;

wherein the first pair of beams defines a first leg and the second pair of beams defines a second leg;

wherein each leg includes a first tank defining a first U-shaped ballast conduit and a second tank defining a second U-shaped ballast conduit, the second tank being larger than the first tank; and wherein the first tank is mounted adjacent the second tank, such that the first tank and the second tank are not fluidly connected.

10. The wind turbine platform in combination with the heel tank damper according to claim 9, wherein each pair of first and second tanks define a heel tank damper configured such that the first U-shaped ballast conduit and the second U-shaped ballast conduit operate to mitigate different frequencies of heel motion.

11. A method of mitigating dynamic responses from heel motion in a wind turbine platform capable of floating on a body of water and supporting a wind turbine thereon comprising:

a wind turbine platform including:

a keystone;

a first pair bottom beams including two bottom beams connected to opposite sides of the keystone;

a second pair of bottom beams including two bottom beams connected to opposite sides of the keystone, wherein the second pair of bottom beams has a longitudinal axis perpendicular to a longitudinal axis of the first pair of the bottom beams, wherein the keystone, the first pair of bottom beams, and the second pair of bottom beams define a foundation;

wherein each bottom beam in the first and second pairs of bottom beams includes an outwardly extending portion at a distal end thereof;

wherein the first and second pairs bottom beams define a foundation having a cruciform shape;

wherein a U-shaped ballast conduit is one of mounted and formed within each of the first pair of bottom beams and the second pair of bottom beams, and extends between the outwardly extending portions of each bottom beam of each of the first and second pairs of bottom beams; and wherein the U-shaped ballast conduits have ballast water therein, the ballast water extending from the outwardly extending portions of each bottom beam of each of the first and second pairs of bottom beams, such that a volume of air is defined between a surface of the ballast water in each outwardly extending portion and an outwardly facing wall of each outwardly extending portion; and an internal damping element within the U-shaped ballast conduits; and a heel tank damper defined by the U-shaped ballast conduits and the internal damping element therein;

the method including mitigating dynamic responses from heel motion by using the ballast water within the U-shaped ballast conduits as a mass element that is allowed to oscillate in a predetermined direction.

12. The method of mitigating dynamic responses from heel motion in a wind turbine platform according to claim 11, further including one of:

using the ballast water within the U-shaped ballast conduits such that a frequency response of the ballast water is determined by a total mass of the ballast water within the U-shaped ballast conduits, a total submerged length of the U-shaped ballast conduits, and a free surface area of the ballast water within the outwardly extending portions, and using the internal damping element within the U-shaped ballast conduits to control a fluid mass response phase.

13. The method of mitigating dynamic responses from heel motion in a wind turbine platform according to claim 11, wherein the heel tank damper is configured to allow the foundation to operate with rigid body heel natural frequencies within a predetermined wave energy range, and in the presence of external damping in the form of viscous drag loading on the foundation.

14. The method of mitigating dynamic responses from heel motion in a wind turbine platform according to claim 11, wherein the foundation is configured such that the ballast water defines a mass element within the heel tank damper allows the foundation to operate with rigid body heel natural frequencies within a predetermined wave energy range.

15. The method of mitigating dynamic responses from heel motion in a wind turbine platform according to claim 11, wherein the heel tank damper uses the ballast water as a mass element that is arranged in a cross-tank configuration that allows for response mitigation about both pitch and roll axes of the foundation.

16. The method of mitigating dynamic responses from heel motion in a wind turbine platform according to claim 11, wherein the ballast conduit within the first pair of bottom beams is not fluidly connected to the ballast conduit within the second pair of bottom beams, and wherein the ballast water in the first and second pairs of bottom beams is separated in fore-aft and side to side conduits arranged in a cross-tank configuration.

17. The method of mitigating dynamic responses from heel motion in a wind turbine platform according to claim 11, wherein the U-shaped ballast conduits in the first and second pairs of bottom beams intersect and are connected within an interior of the keystone such that the foundation will experience equivalent damper responses for dynamic heeling about any direction of heel motion.

18. A wind turbine platform capable of floating on a body of water and supporting a wind turbine thereon in combination with a heel tank damper comprising:

a wind turbine platform including:

four connected bottom beams that extend radially outwardly from central point and define a foundation having a cruciform shape, wherein each bottom beam includes an outwardly extending portion at a distal end thereof;

wherein an outwardly facing wall of each outwardly extending portion includes an opening that extends between an interior of the outwardly extending portion and the atmosphere outside of the outwardly extending portion; and a cross shaped wall having four legs that extend vertically between a lower wall of each beam and an upper wall of each beam, the distal ends of each of the four legs are spaced apart from distal end walls of each beam; and an integrated heel tank damper having multiple ballast conduits formed between the cross shaped wall and the walls of each beam, the multiple ballast conduits defining multiple fluid flow paths within the foundation.

19. The wind turbine platform in combination with the heel tank damper according to claim 18, wherein a natural frequency of the integrated heel tank damper within the foundation may be increased and decreased by changing the lengths of the four legs of the cross shaped wall within each beam.

20. The wind turbine platform in combination with the heel tank damper according to claim 1;

wherein the first pair of beams defines a first leg and the second pair of beams defines a second leg;

wherein each leg includes a first tank defining a first U-shaped ballast conduit and a second tank defining a second U-shaped ballast conduit, the second tank being larger than the first tank; and wherein the first tank is mounted adjacent the second tank, such that the first tank and the second tank are not fluidly connected.

21. The wind turbine platform in combination with the heel tank damper according to claim 20, wherein each pair of first and second tanks define a heel tank damper configured such that the first U-shaped ballast conduit and the second U-shaped ballast conduit operate to mitigate different frequencies of heel motion.

22. A wind turbine platform capable of floating on a body of water and supporting a wind turbine thereon in combination with a heel tank damper comprising:

a wind turbine platform including:

a keystone;

a first pair bottom beams including two bottom beams connected to opposite sides of the keystone;

a second pair of bottom beams including two bottom beams connected to opposite sides of the keystone, wherein the second pair of bottom beams has a longitudinal axis perpendicular to a longitudinal axis of the first pair of the bottom beams, wherein the keystone, the first pair of bottom beams, and the second pair of bottom beams define a foundation having a cruciform shape;

wherein each bottom beam in the first and second pairs of bottom beams includes an outwardly extending portion at a distal end thereof;

wherein a U-shaped ballast conduit is one of mounted and formed within each of the first pair of bottom beams and the second pair of bottom beams, and extends between the outwardly extending portions of each bottom beam of each of the first and second pairs of bottom beams; and wherein the U-shaped ballast conduits have ballast water therein, the ballast water extending from the outwardly extending portions of each bottom beam of each of the first and second pairs of bottom beams, such that a volume of air is defined between a surface of the ballast water in each outwardly extending portion and an outwardly facing wall of each outwardly extending portion;

an interior wall within each bottom beam that extends vertically between a lower wall and an upper wall of each bottom beam, and further extends longitudinally from distal end walls of each bottom beam to a vertically extending exterior wall of the keystone; and a cross-shaped wall within the keystone that extends vertically between a lower wall and an upper wall of the keystone, wherein each leg of the cross-shaped wall is longitudinally aligned with one of the interior walls of the bottom beams, and wherein the exterior walls and each of the legs of the cross-shaped wall of the keystone have vertically extending fluid flow openings formed therein, and define an internal damping element; and a heel tank damper system defined by the combination of the U-shaped ballast conduits and a plurality of fluid flow paths defined by the fluid flow openings in the walls of the keystone.

23. The wind turbine platform in combination with the heel tank damper according to claim 22, wherein the flow of ballast water through the U-shaped ballast conduits and the fluid flow openings of the heel tank damper system provides a damping response for the wind turbine platform.

24. The method of mitigating dynamic responses from heel motion in a wind turbine platform according to claim 11, further including the step of moving the internal damping element between an open position and a closed position, such that when ballast water within one of the U-shaped ballast conduits has moved to a desired position wherein the wind turbine platform is righted and balanced while floating, the internal damping element is moved to the closed position.

25. The method of mitigating dynamic responses from heel motion in a wind turbine platform according to claim 11, further including the step of one of actively and passively tuning a frequency response of the heel tank damper by adjusting a total mass of the ballast water.

26. The method of mitigating dynamic responses from heel motion in a wind turbine platform according to claim 11, further including the step of one of actively and passively tuning the internal damping element to respond to waves having with the range of from about 10 to about 19 second peak wave periods, and to respond to period ranges wherein the natural period of a pitch and heel of the wind turbine platform is greater than about 20 seconds.

27. The method of mitigating dynamic responses from heel motion in a wind turbine platform according to claim 11, further including the step of receiving external measurements from environmental sensors on a wave buoy and actively tuning the heel tank damper based on the external measurements received from the wave buoy.

28. A semi-submersible wind turbine platform capable of floating on a body of water and supporting a wind turbine thereon in combination with a heel tank damper comprising:

a semi-submersible wind turbine foundation including:

a keystone;

three bottom beams that extend radially outwardly from the keystone;

a center column mounted to the keystone;

three outer columns mounted at distal ends of the bottom beams;

wherein a space within the center column, each outer column, the keystone and the bottom beam therebetween define three generally U-shaped ballast conduits;

wherein the U-shaped ballast conduits have ballast water therein, the ballast water extending from the outwardly extending portions of each bottom beam of each of the first and second pairs of bottom beams, such that a volume of air is defined between a surface of the ballast water in each outwardly extending portion and an outwardly facing wall of each outwardly extending portion; and an internal damping element within the U-shaped ballast conduits; and a heel tank damper defined by the combination of the three U-shaped ballast conduits.

29. The semi-submersible wind turbine platform in combination with the heel tank damper according to claim 28, wherein an outwardly facing wall of each column includes an opening that extends between an interior of the column and the atmosphere outside of the column.

30. The semi-submersible wind turbine platform in combination with the heel tank damper according to claim 28, wherein the internal damping element is one of a wall having an orifice therethrough, a wall having a movable orifice therethrough, and a gate valve.

* * * * *